United States Patent [19]

Wingfield

[11] 4,385,461

[45] May 31, 1983

[54] SEQUENTIALLY HIGHLIGHTING COPY HOLDER

[76] Inventor: Hale Wingfield, 240 W. 73rd St., New York, N.Y. 10023

[21] Appl. No.: 166,776

[22] Filed: Jul. 8, 1980

[51] Int. Cl.[3] ..... B41J 11/64; B41J 11/38; B41J 29/18

[52] U.S. Cl. ..... 40/352; 40/341; 40/442; 40/902; 400/711; 400/716

[58] Field of Search ..... 40/352, 353, 341, 346, 40/442, 356, 902, 463; 400/718, 718.1, 718.2, 711, 716; 434/227, 228, 231; 234/40; 362/98; 116/240; 340/366 D, 711

[56] References Cited

U.S. PATENT DOCUMENTS

| | | | |
|---|---|---|---|
| 1,438,268 | 12/1922 | Searle | 350/238 |
| 2,487,318 | 11/1949 | Elliott | 40/902 |
| 2,642,841 | 6/1953 | Funk | 40/354 |
| 2,883,255 | 4/1959 | Anderson | 400/716 |
| 2,985,869 | 5/1961 | Arasmith | 340/502 |
| 3,201,568 | 8/1965 | O'Donnell | 219/538 |
| 3,208,160 | 9/1965 | Smith | 400/711 |
| 3,724,111 | 4/1973 | Grieger | 40/367 |
| 3,763,989 | 10/1973 | Goldman | 400/718.1 |
| 3,803,971 | 4/1974 | del Castillo | 40/356 |
| 4,043,064 | 8/1977 | Friedman | 400/718.2 X |

*Primary Examiner*—Robert Peshock

*Assistant Examiner*—Michael J. Foycik, Jr.

*Attorney, Agent, or Firm*—Darby & Darby

[57] ABSTRACT

This sequentially highlighting copy holder employs fields of light as the frame of reference for an operator of a keyboard machine in keeping the place in the text of a document page. The page is affixed upon the copy holder for processing and is illuminated, portion by portion, as the place in the text advances. In one place keeping function the perceived effect of this highlighting delivered in sequence is that of a slender field of light slowly descending the document page. In another, the field of light disappears as a second field appears lower on the page, overlapping the position of the first field of light and disappearing in turn as a third field appears, overlapping the position of the second, so that as the place in the text moves downward the field of light moves with it in salient changes of position, holding to the moving place of attention in the text. In yet another function, ongoing input entered into the keyboard machine sets the downward pace of the field of light. In one of the other functions, large and small undivided portions of the text are highlighted for such special applications as the processing of batches of short forms. The electronic manual, electronic mechanical and microprocessor embodiments reserve, for the operator, overriding control of both the rate of movement and the intensity of the place keeping field of light.

14 Claims, 47 Drawing Figures

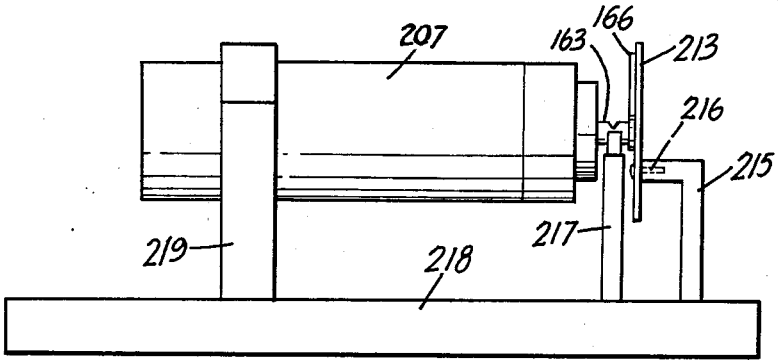
FIG.38
FIG.40
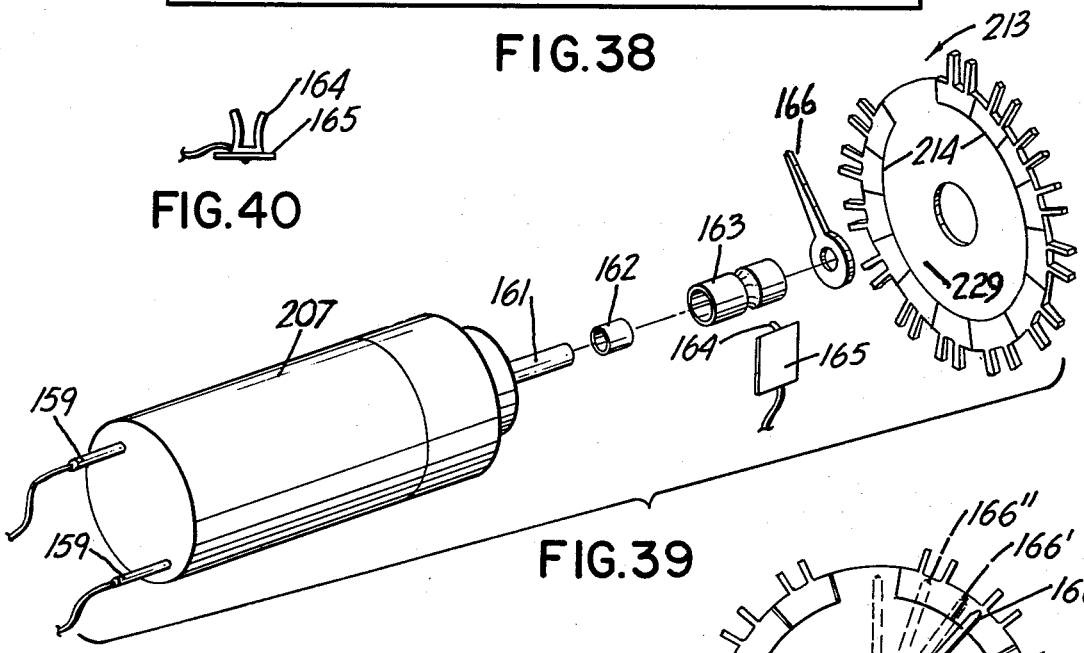
FIG.39
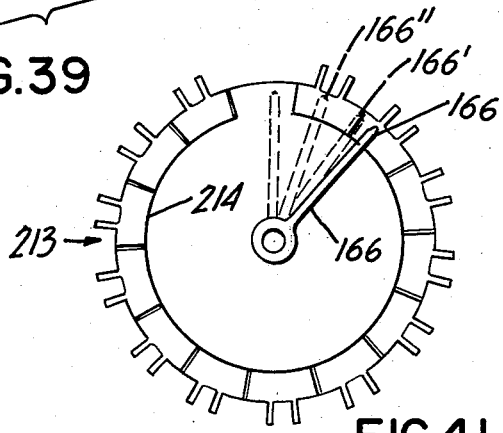
FIG.41
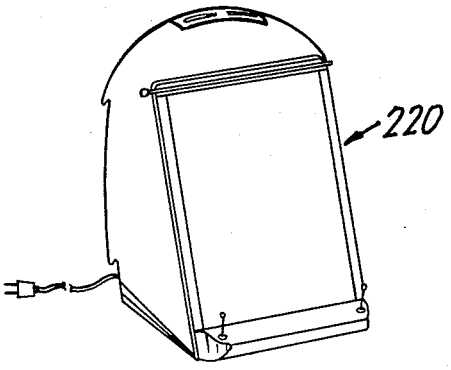
FIG.42
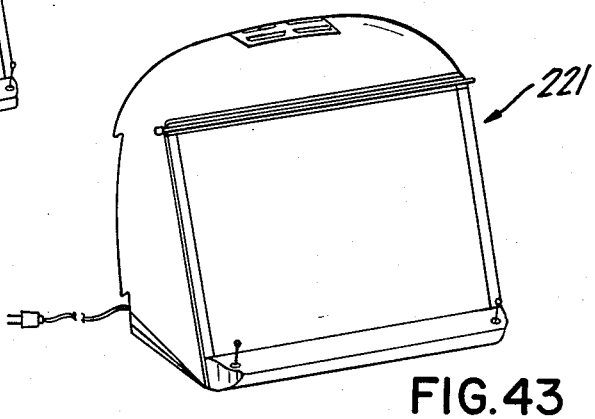
FIG.43

SEQUENTIALLY HIGHLIGHTING COPY HOLDER

This sequentially highlighting copy holder employs fields of light as the frame of reference for an operator of a keyboard machine in keeping the place in the text of a document page. The page is affixed upon the copy holder for processing and is illuminated, portion by portion, as the place in the text advances. In one place keeping function the perceived effect of this highlighting delivered in sequence is that of a slender field of light slowly descending the document page. In another, the field of light disappears as a second field appears lower on the page, overlapping the position of the first field of light and disappearing in turn as a third field appears, overlapping the position of the second, so that as the place in the text moves downward the field of light moves with it in salient changes of position, holding to the moving place of attention in the text. In yet another function, ongoing input entered into the keyboard machine sets the downward pace of the field of light. In one of the other functions, large and small undivided portions of the text are highlighted for such special applications as the processing of batches of short forms. The electronic manual, electronic mechanical and microprocessor embodiments reserve, for the operator, overriding control of both the rate of movement and the intensity of the place keeping field of light.

Recently a manufacturer introduced a silent keyboard machine and was constrained by the market to redesign it with provision made for the familiar clicking sound of a keyboard. The professional keyboard operator employs the sound and the feel of the keys, and an individual typing rhythm developed personally to enter as input an average of one to two words per second, keyboarding in combinations of characters "automatically," rarely glancing at the work, correcting any misstrike on the spot in a fraction of a second. The operator of the 1980s has been trained by improved methods, and uses strikingly improved machines. And the momentum of this trend should continue. The industry producing the equipment, document processing systems which usually are called "word processing systems," is growing by 30% per year.

When a source document comes to the operator, the operator will need assistance in keeping the place in the text as the document is processed, even if the work is cleanly presented and well lighted. Often an assignment arrives as maculate photocopies or as material given in questionable handwriting, or as photocopies with marginal and interlinear handwriting.

In accomplishing this fast yet close and demanding task, the operator can elevate performance ratings by using a moving frame of reference which will follow the point of attention in the inscription on the page as the point advances moment by moment. Certain copy holders which used to designate the typing line a single line at a time have been rejected by those who keyboard at present-day speeds; operators of document processors, calculators, typewriters and computers prefer to work from a sheet lying on the desk top for viewing at an acute angle.

Large and growing numbers of operators transcribe, edit and extract from the pages by following the meaning of what they keyboard. Doing so requires that they look back momentarily, from time to time, at phrases already entered as input, and look ahead for what is coming. Separating away the 50 lines of the page line by line would offer too small a frame of reference. Using the margins of the page itself with its hundreds of words would give too large a frame; the place in the text may be lost by distraction, interruption, involvement of the operator with a sentence being processed, or by repeated uses of a phrase or proper name in the text. When repetitive wording is encountered, a common occurrence in business, financial and law documentation, even the expert operator may inadvertently skip a passage or enter one twice, mistaking one use of the repeated wordage for another use of it. Realizing that anyone can lose the place of work in the lines of words and columns of figures on the pages, highly skilful operators may proceed with caution through the day, diminishing production and perhaps elevating stress.

The sequentially highlighting copy holder utilizes a frame of reference somewhat wider than the inscription on the sheet most commonly put to office use and eight standard single spaced lines high. Apart from functions assigned to special applications which are described herein, the copy holder advances this guiding frame by only half its height at each movement of the frame downward, with the result that the place in the text may be kept away from the horizontal edges of the frame of reference.

The frame of reference used is one of illumination. The slender rectangular field of light does serve as the guide as the operator produces 10-word lines of input about every ten seconds; the operator who has viewed a video tube frequently for decades and is using a processing machine with a display in his work would find it only natural to turn the source document into a lighted screen.

In addition to performing the place keeping function, however, the copy holder provides needed illumination. As specified herein, this illumination is emitted in one embodiment from a fraction of an inch away from the inscription; in all embodiments the illumination is emitted from less than a page width away.

It is task lighting which stands independent of ambient lighting of the work station. Reflectance on work station surfaces may vary by 300% under ceiling lighting, and glare zones may be formed. The ceiling installation may fall short of meeting the individual need of a particular station. In the present trend toward conservation of energy, some offices are removing one-third of the lamps from the troffers to reduce thermal output in the summertime with its elevated office temperature and are leaving the lamps out of use the year round. In response, manufacturers are marketing ballasts which cut energy use and light output by one-half. The evenly cast, highly variable localized illumination provided by the copy holder assures that the contrast between the characters of the inscription being processed and the background upon which they appear fulfils the preference held by the operator. And, each watt used is used with efficiency.

The keyboard operator must sit with shoulders exactly square with the machine, and turn the head to one side to view the source document page. With many of today's input machines exceeding two feet in width, this means that any copy holder must be small and be emplaced against the input machine, for hours spent daily with the head turned may cause neck, shoulder and even back pain. The sequentially highlighting copy holder is a small instrument. It is of a width over all, except for the paper retention, which is out of the way at the top of the copy holder, of exactly the width of the sheet finding the most common office use. The corners of the copy holder are severely rounded to bring the copy holder as close as possible to the forward line of sight of the operator. This cornering brings it closer by several degrees.

With much of the business of an office being conducted by telephone, other telecommunication and frequent short informal meetings held at desks, often at the keyboard operator's desk, it may be said that must work stands subject to interruption at most times. The keyboard operator cannot lose the place in the text of the inscription even so. Five embodiments of the invention hold the field of light motionless at the press of a button until the button is released. The other two embodiments hold the highlighting upon the place of attention without the performance of any act at all when keyboarding activity is interrupted.

Among other users of the invention: Students of speed keyboarding; students of speed reading; individuals who are reviewing documents; and groups of about three who meet to examine a document page by page.

FIG. 1 depicts sequentially highlighting copy holder performing basic Descend function in First and Second Embodiments.

FIG. 2 gives side view of copy holder in First, Second, Fourth and Sixth Embodiments.

Figure 10:
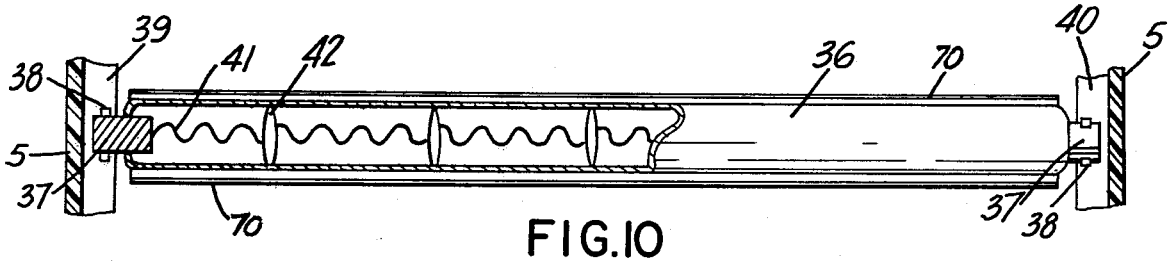

FIG. 10 gives front view of incandescent lamp in First and Sixth Embodiments.

Figure 11:
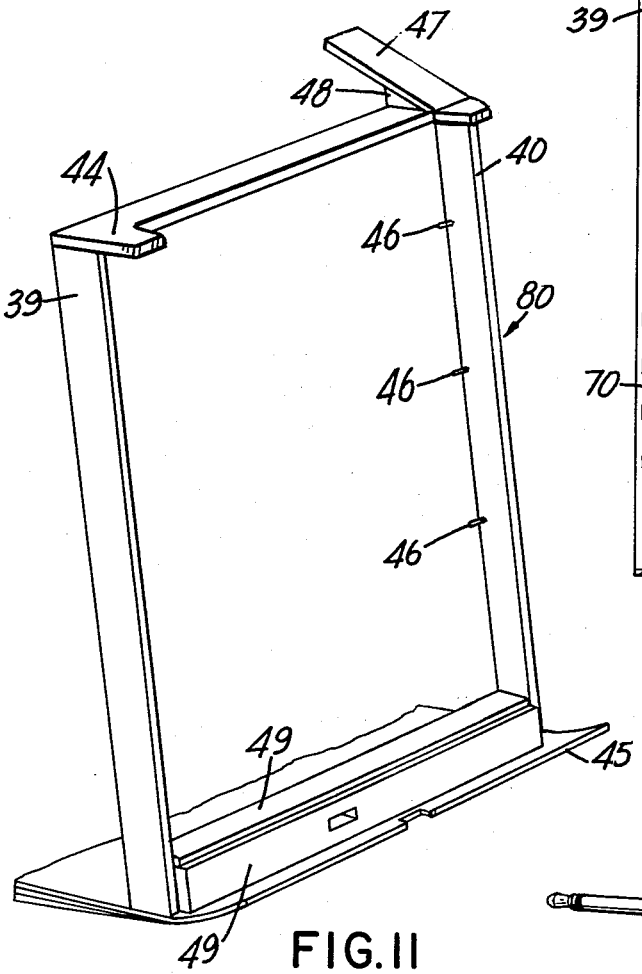

FIG. 11 depicts, in perspective, framework in First, Second, Fourth and Sixth Embodiments.

Figure 12:
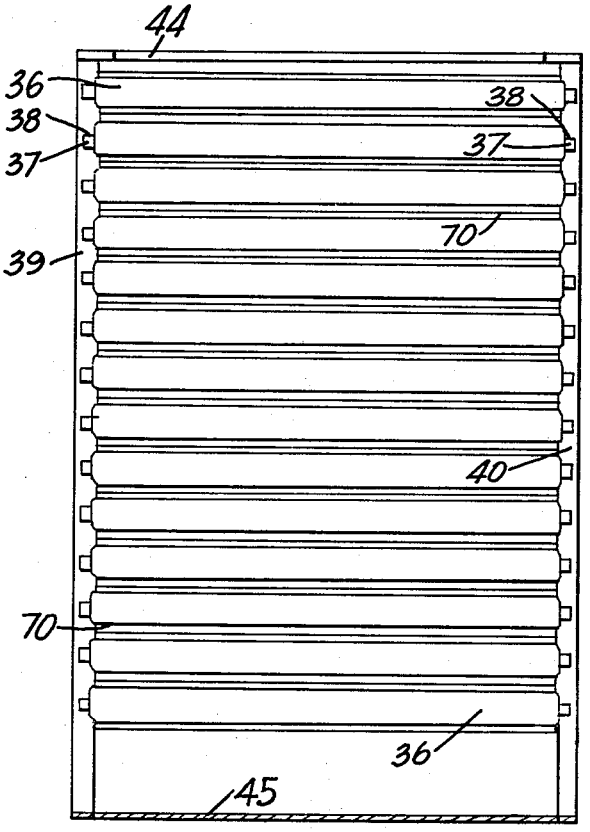

FIG. 12 is front view of battery of incandescent lamps in First and Sixth Embodiments.

Figure 13:
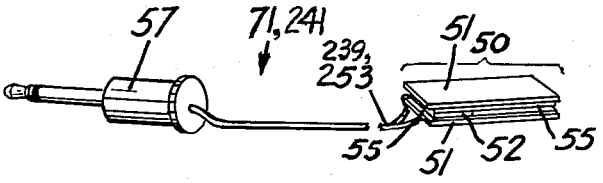

FIG. 13 shows first and second keyboard sensors in First, Second and Third Embodiments.

Figure 14:
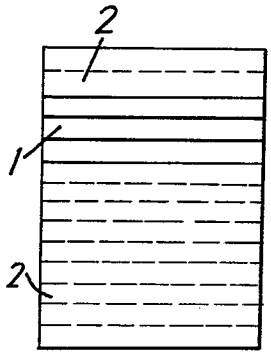

FIG. 14 is a diagram of emplaced document page with copy holder performing Descend function cycle in First, Second and Third Embodiments.

Figure 15:
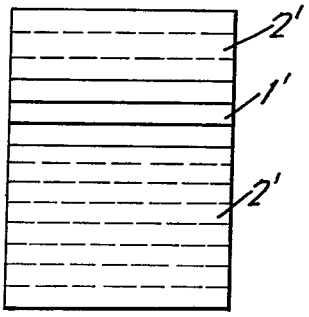

FIG. 15 is a diagram of document page with copy holder performing Descend function cycle which follows the cycle diagrammed in FIG. 14, in First, Second and Third Embodiments.

Figure 16:
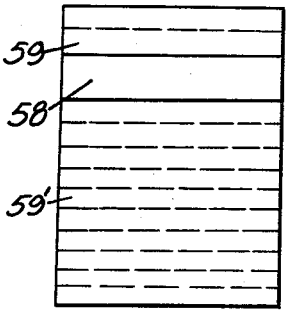

FIG. 16 is a diagram of document page with copy holder performing Stride place keeping function in First, Second, Third, Sixth and Seventh Embodiments, and Step place keeping function as well, in First, Second, Third, Fourth and Fifth Embodiments.

Figure 17:
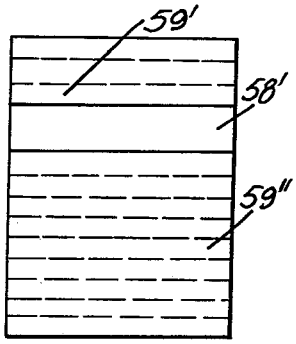

FIG. 17 is a diagram of emplaced page of document with the copy holder performing the next succeeding cycle of Stride function diagrammed in FIG. 16, in the First, Second, Third, Sixth and Seventh Embodiments and, as well, the next succeeding cycle of the Step function cycle diagrammed in FIG. 16, in the First, Second, Third, Fourth and Fifth Embodiments.

Figure 18:
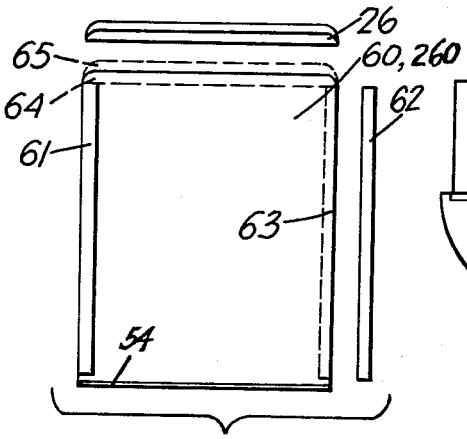

FIG. 18 represents face plate and framings in First, Second, Fourth and Sixth Embodiments.

Figure 19:
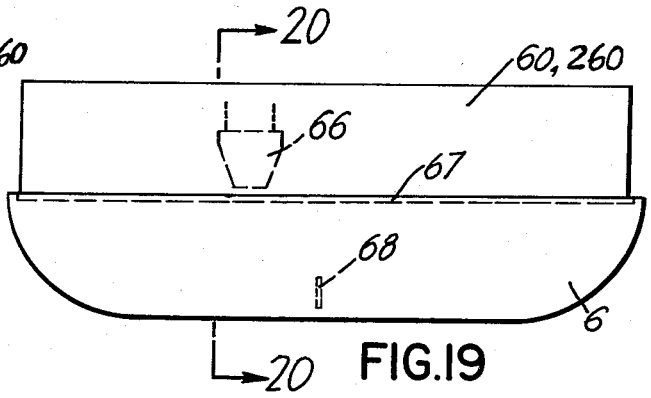

FIG. 19 is a top view of face plate and console cover in all Embodiments and, in First, Second and Third Embodiments, jack.

Figure 20:
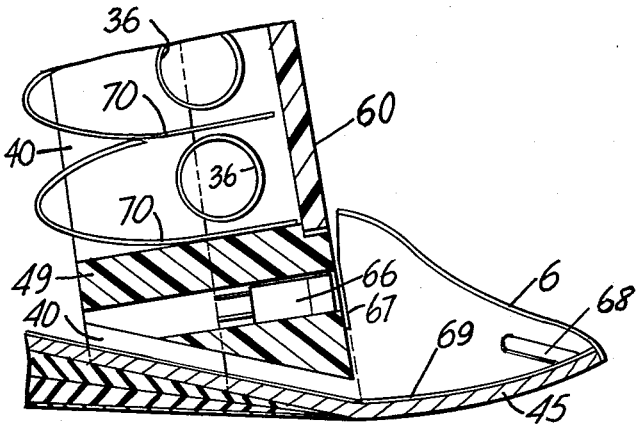

FIG. 20 is cross section of FIG. 19 showing light emission installation of First and Sixth Embodiments.

Figure 21:
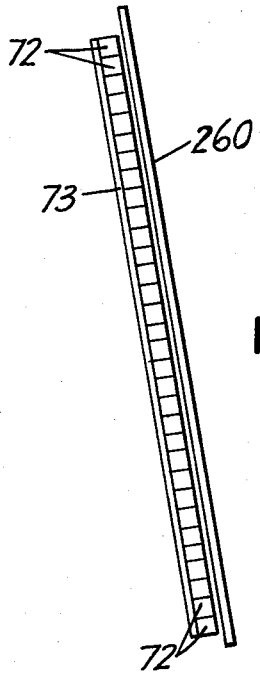

FIG. 21 is side view of LED (light emitting diode) installation in Second Embodiment.

Figure 22:
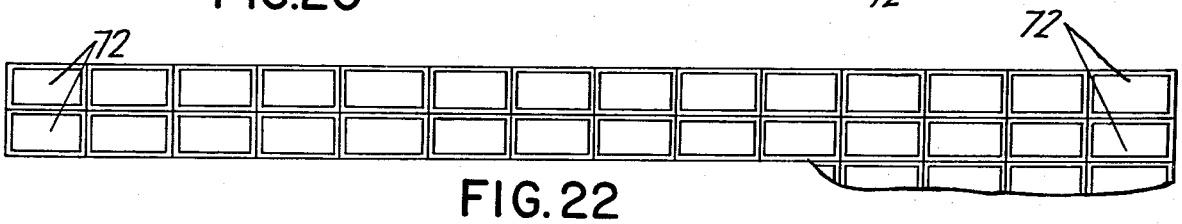

FIG. 22 is front view of one highlighting zone comprising two rows of LEDs, and a portion of a third row of LEDs, in Second Embodiment.

Figure 23:
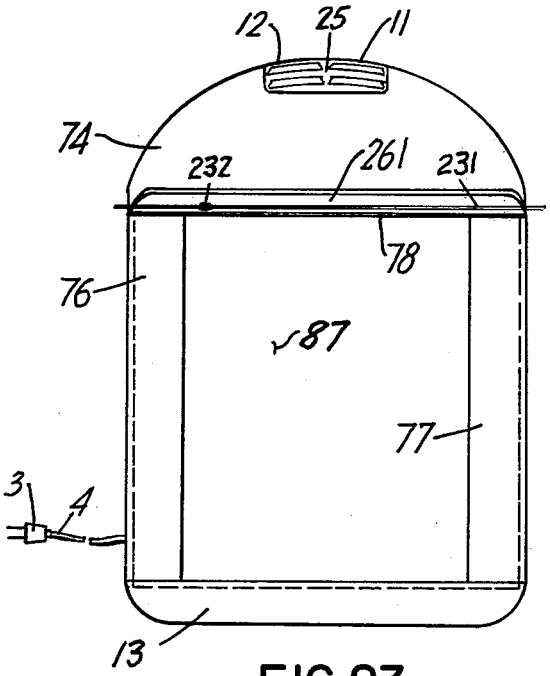

FIG. 23 is front view of copy holder, with shielding, in Third, Fifth and Seventh Embodiments.

Figure 24:
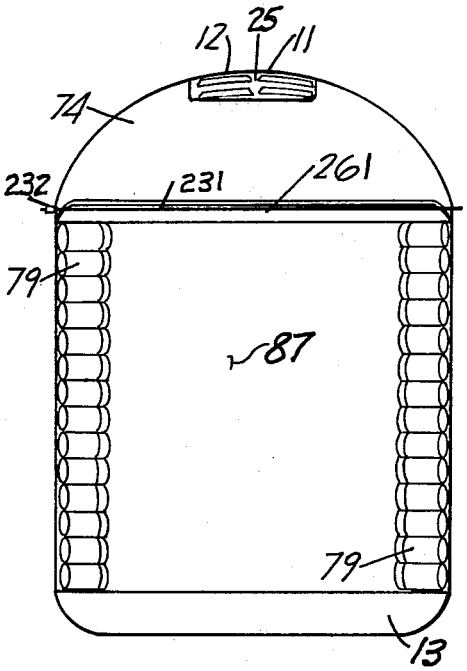

FIG. 24 is front view of copy holder, with shielding removed, in Third, Fifth and Seventh Embodiments.

Figure 25:
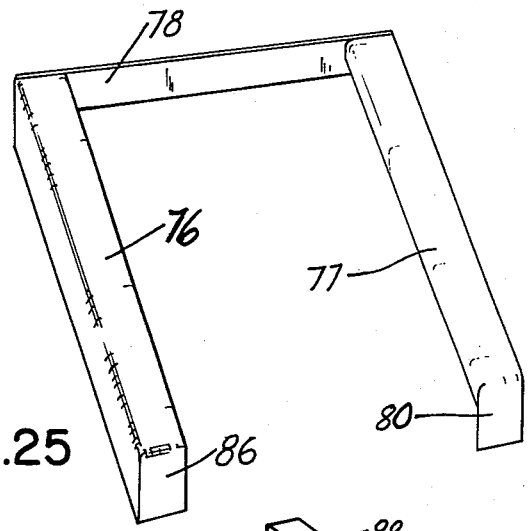

FIG. 25 is a perspective drawing of shielding in Third, Fifth and Seventh Embodiments.

Figure 26:
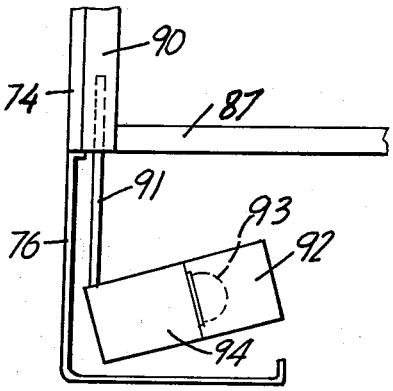

FIG. 26 is top view of lefthand light emission assembly in Third, Fifth and Seventh Embodiments.

Figure 27:
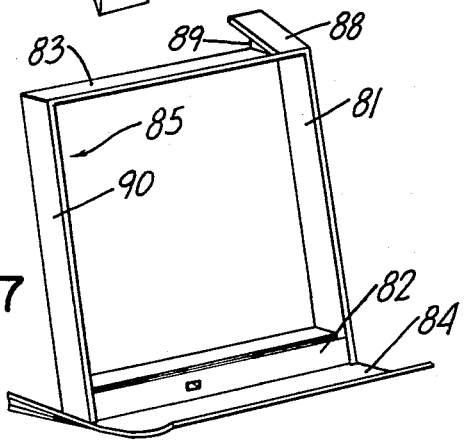

FIG. 27 is perspective of framework in Third, Fifth and Seventh Embodiments.

Figure 28:
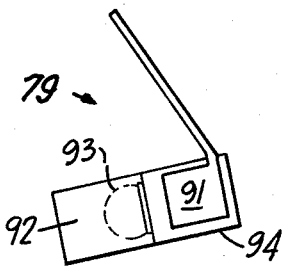

FIG. 28 is bottom view of light emission assembly in Third, Fifth and Seventh Embodiments.

Figure 29:
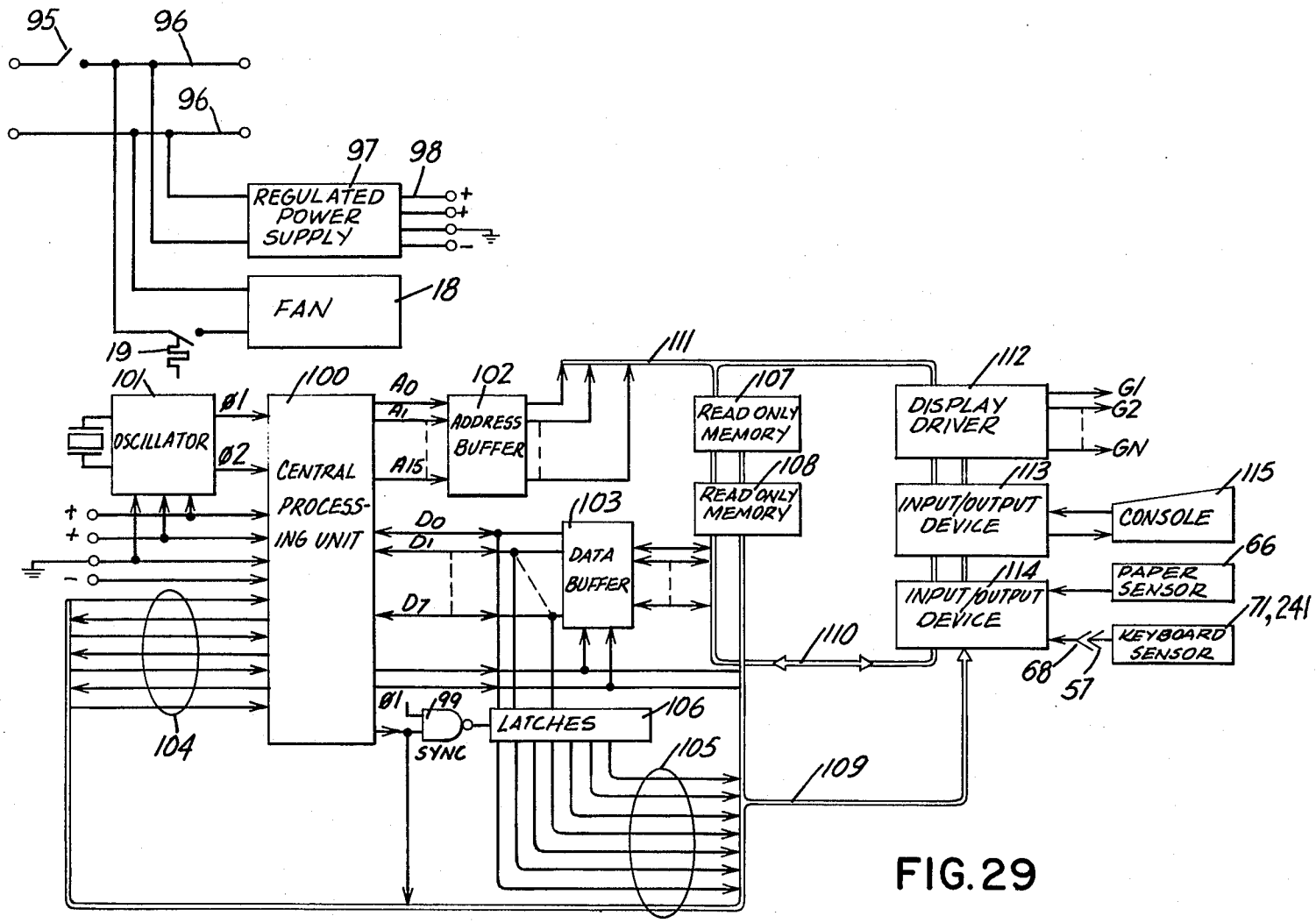

FIG. 29 is block diagram of power and control circuitry of data processing system with nonvolatile memory in First, Second and Third Embodiments.

Figure 30:
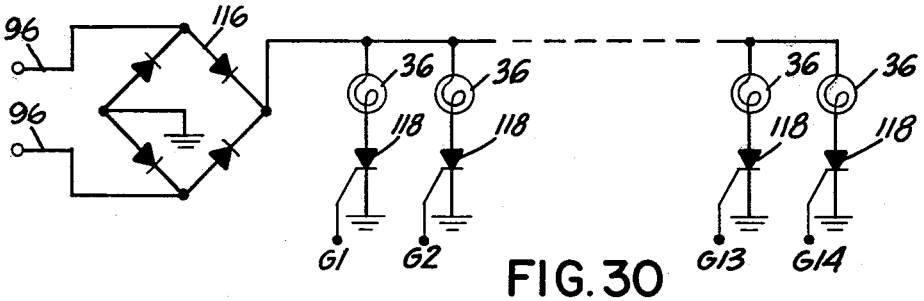

FIG. 30 is diagram of display system in First Embodiment.

Figure 31:
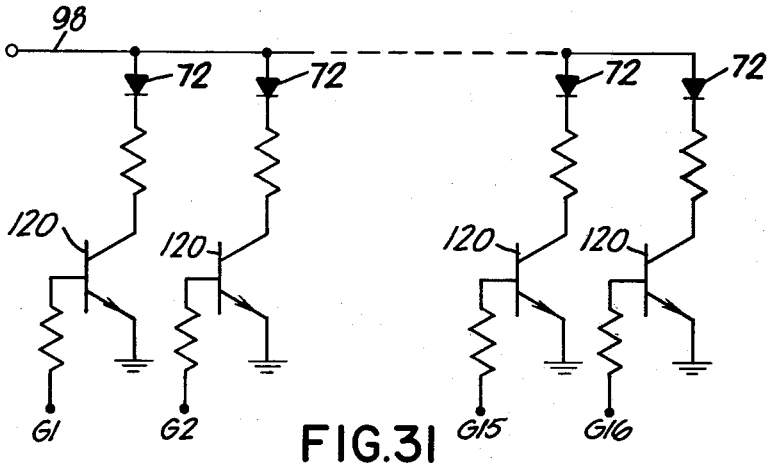

FIG. 31 is diagram of display system in Second Embodiment.

Figure 32:
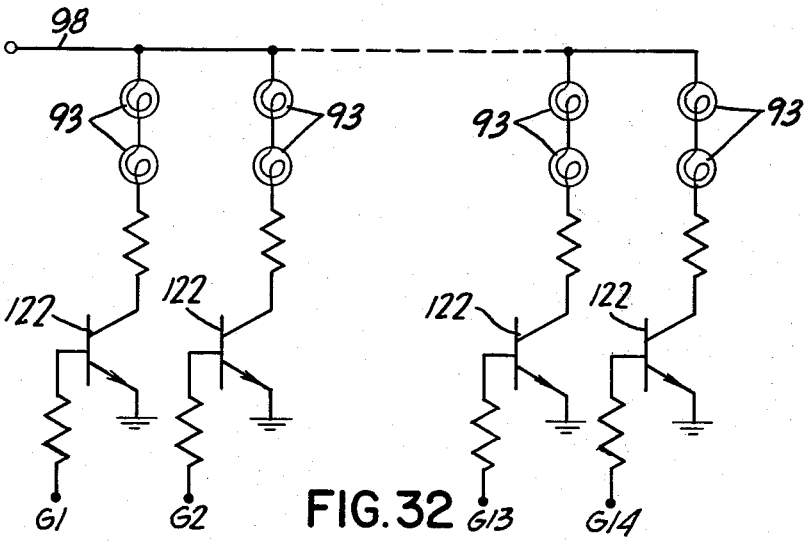

FIG. 32 is diagram of display system in Third Embodiment.

Figure 33:
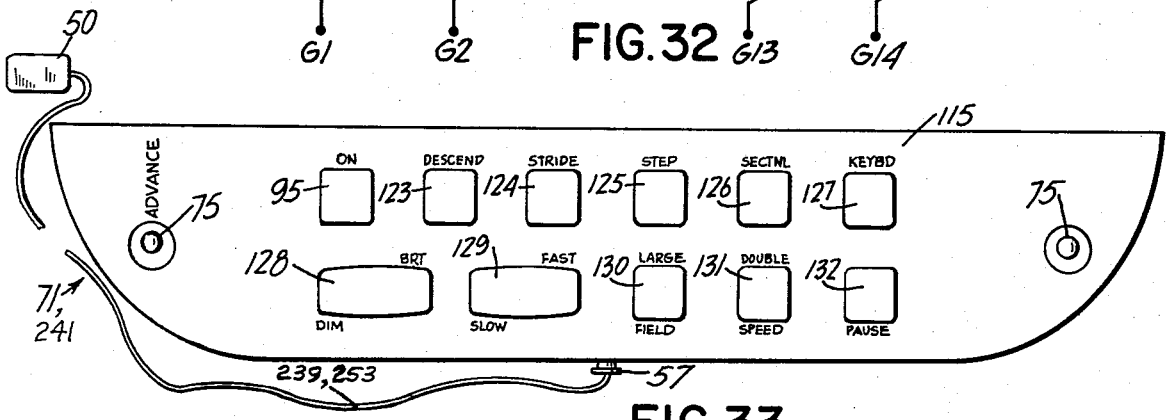

FIG. 33 is console and first and second keyboard sensors in First, Second and Third Embodiments.

Figure 34:
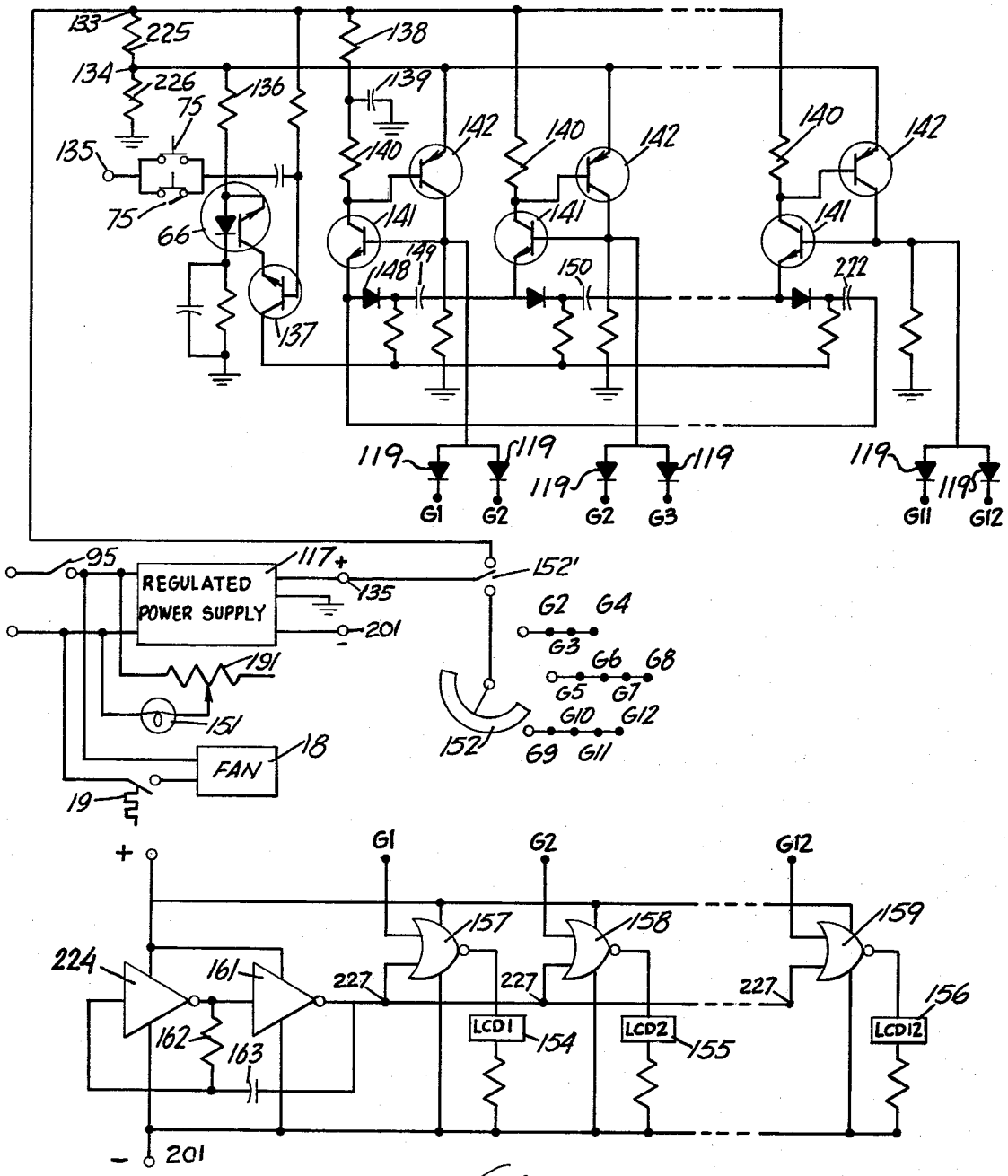

FIG. 34, a diagram, represents electronic circuitry of Fourth Embodiment.

Figure 35:
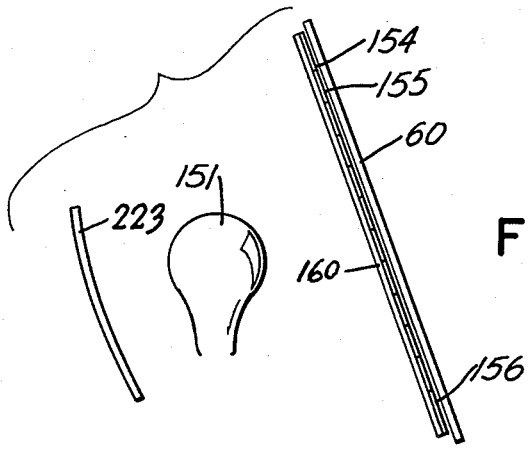

FIG. 35 is a fragmentary side view of liquid crystal display system in Fourth Embodiment.

Figure 36:
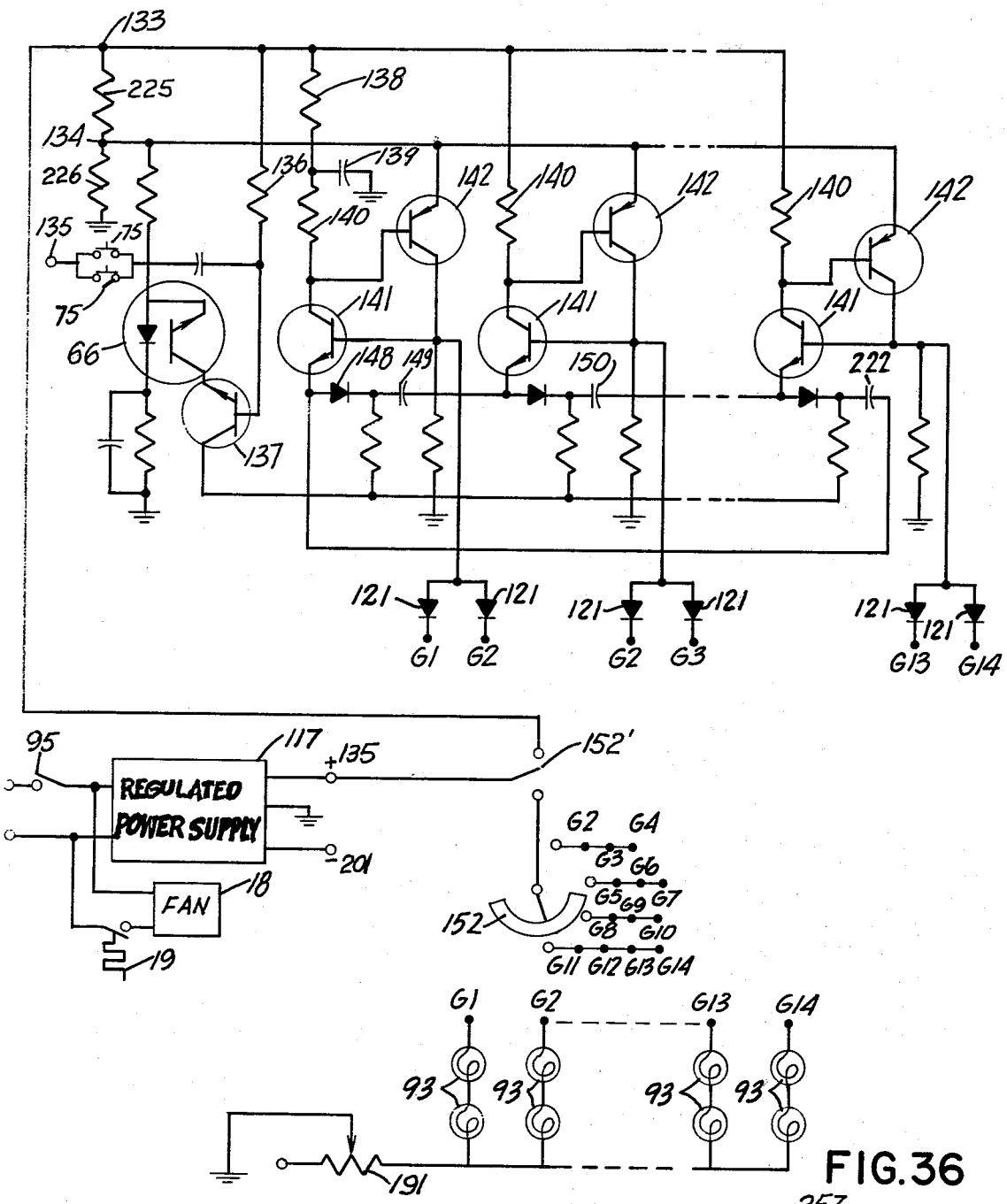

FIG. 36 is a diagram of electronic circuitry of manual Fifth Embodiment.

Figure 37:
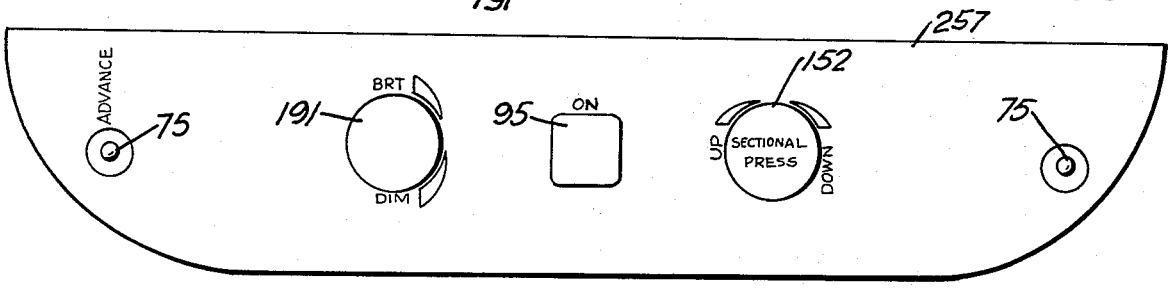

FIG. 37 represents console in Fourth and Fifth Embodiments.

FIG. 38 is drawing of motor gearhead and contact assembly in Sixth and Seventh Embodiments.

FIG. 39 is exploded view of motor gearhead and contact assembly in Sixth and Seventh Embodiments.

FIG. 40 is side view of gold brush in Sixth and Seventh Embodiments.

FIG. 41 is diagram showing initial positions of wiper in circumvolution of contact disk, in Sixth and Seventh Embodiments.

FIG. 42 portrays alternate legal sized model of First, Second, Fourth and Sixth Embodiments of the sequentially highlighting copy holder.

FIG. 43 portrays wide model of Second and Fourth Embodiments.

Figure 44:
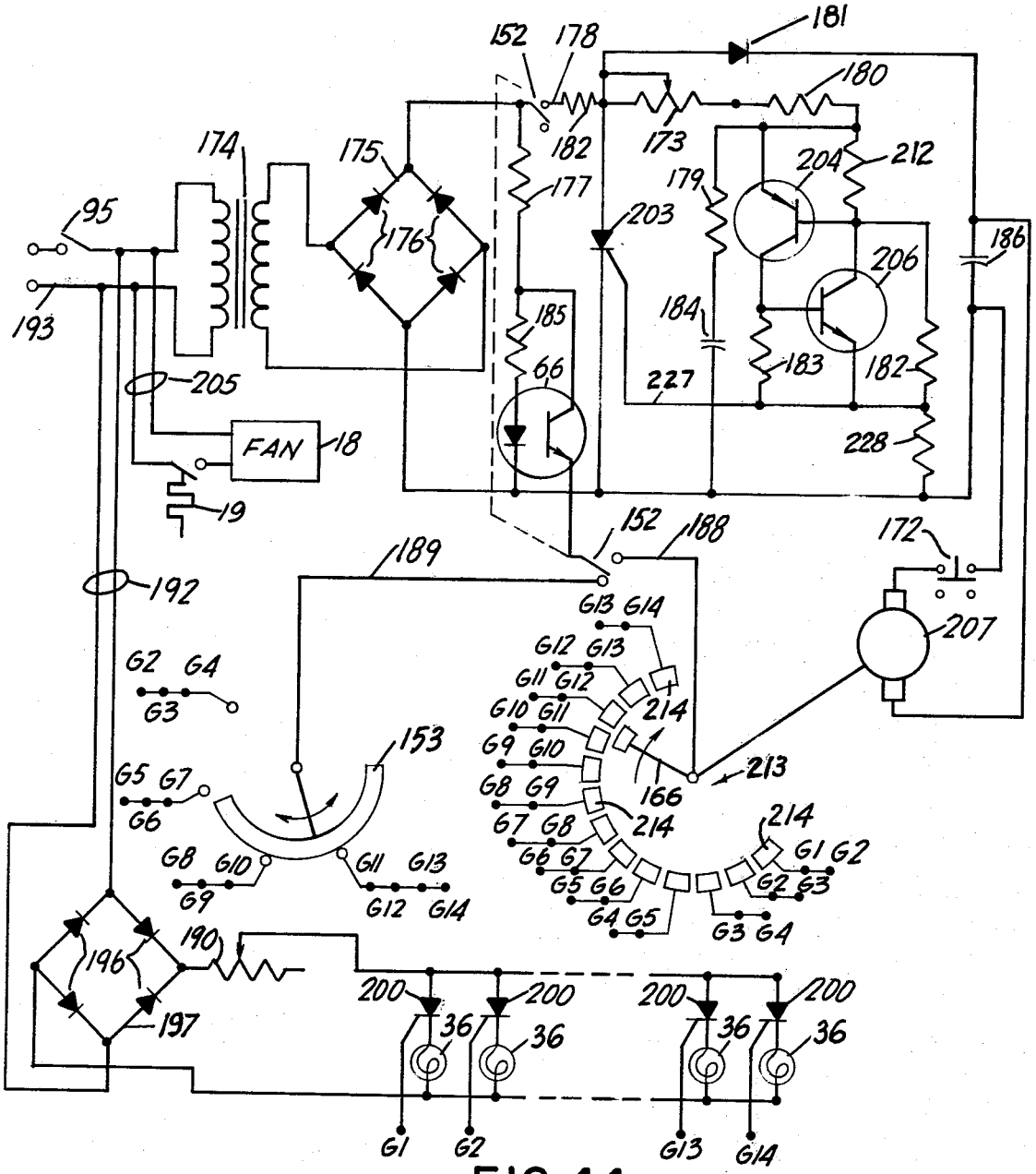

FIG. 44 is diagram of electronic circuitry of electromechanical Sixth Embodiment.

Figure 45:
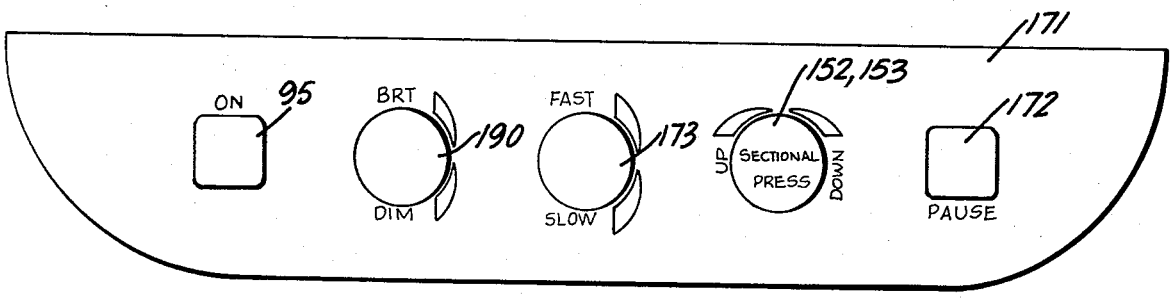

FIG. 45 is representation of console in Sixth and Seventh Embodiments.

Figure 46:
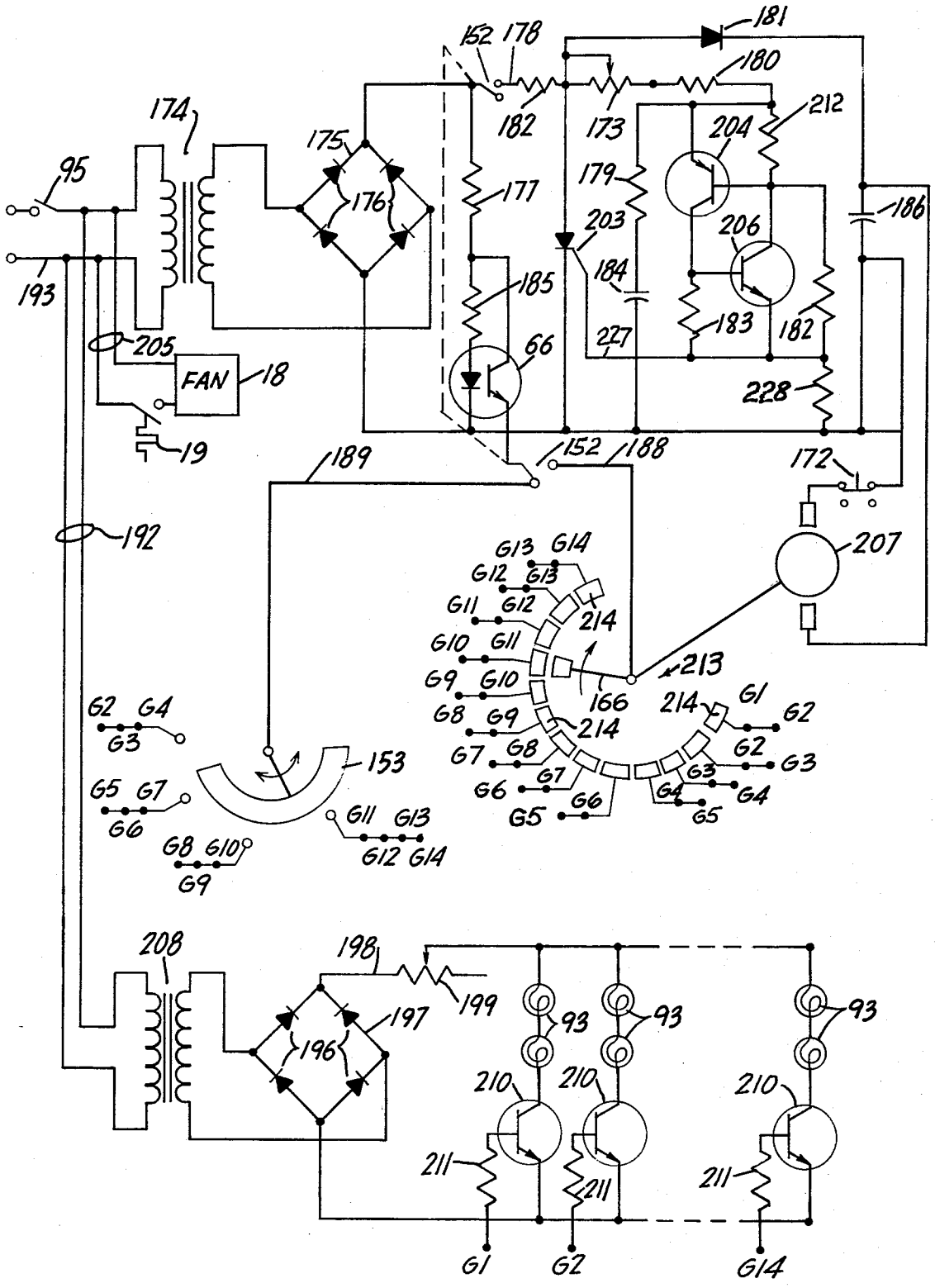
Figure 47:
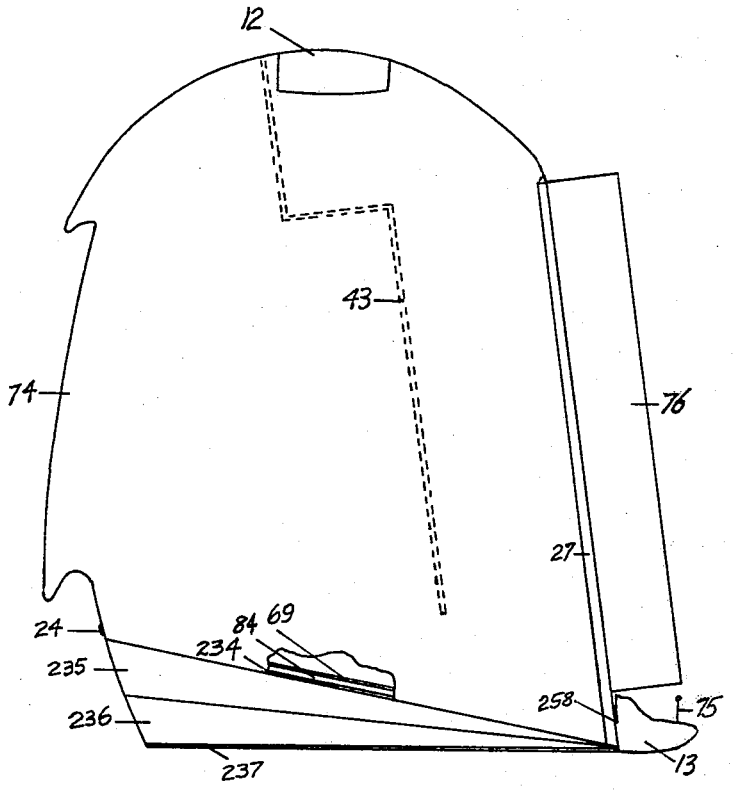

FIG. 46 is diagram of electronic circuitry of electromechanical Seventh Embodiment, and FIG. 47 is side view of copy holder in Third, Fifth and Seventh Embodiments.

DETAILED DESCRIPTION

Figure 2:
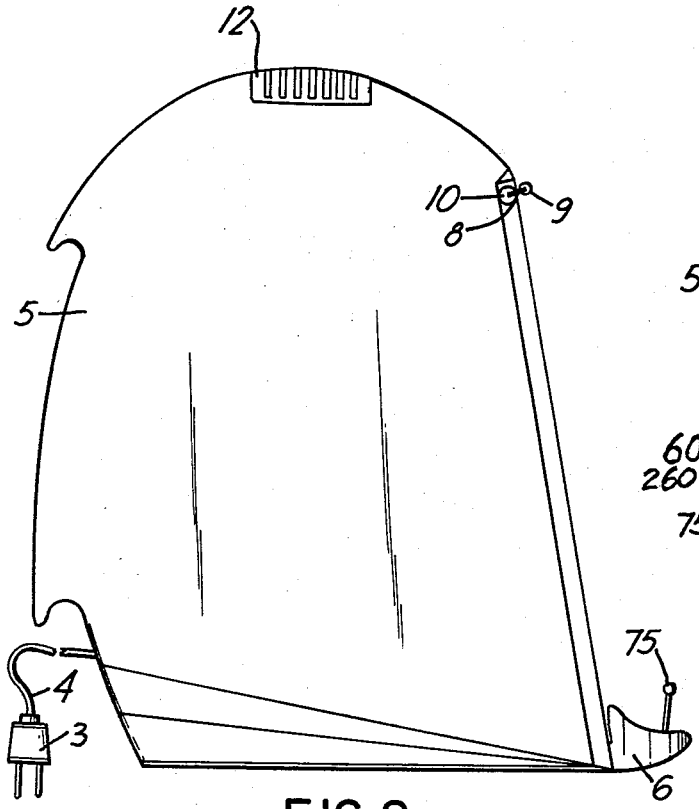
Figure 8:
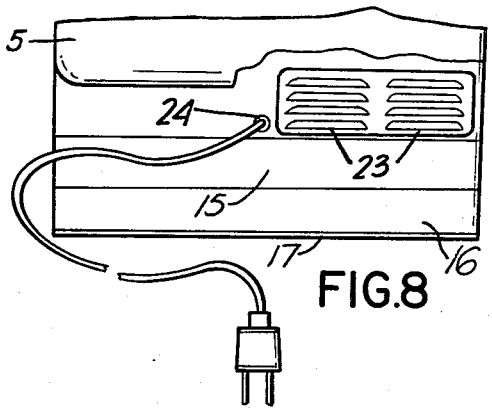
FIG. 8 is fragmentary drawing of bottom portion of back of copy holder in all Embodiments.

All embodiments of the nonspherical, sequentially highlighting copy holder receive power from utility line through plug 3 and cord 4, FIG. 2. In First, Second, Fourth and Sixth Embodiments cord 4 enters copy holder at aperture in hood 5, FIG. 8, through strain relief 24. In Third, Fifth and Seventh Embodiments cord 4, FIG. 47, so enters hood 74.

In First, Second, Fourth and Sixth Embodiments copy holder comprises plastic hood 5, FIG. 2, and plastic console cover 6 as main exterior components. In Third, Fifth and Seventh Embodiments copy holder comprises plastic hood 74, FIG. 23, and plastic console cover 13 as main exterior components.

Figure 4:
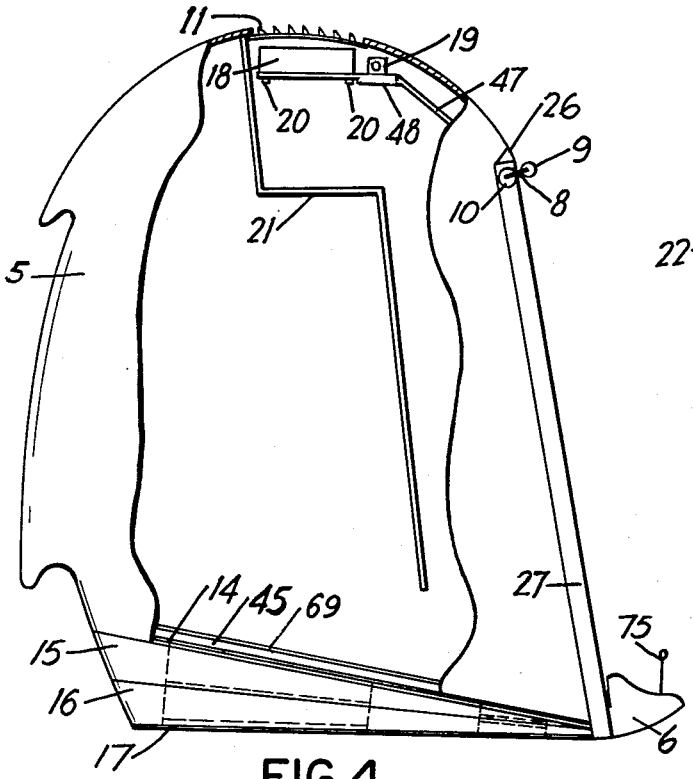
FIG. 4 is cutaway side view of copy holder in First, Second, Fourth and Sixth Embodiments.
Figure 6:
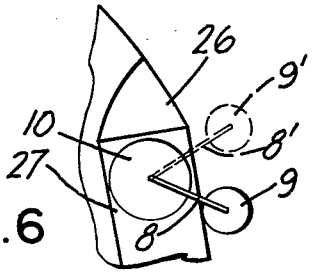
FIG. 6 is side view of paper retention bar and paper roller in all Embodiments.

In First, Second, Fourth and Sixth Embodiments metal paper retention bar 8, FIG. 4, is secured by rubber friction fit grommet 10 at each end of said paper retention bar; said bar supports rubber paper roller 9 with metal detent. Paper retention bar 8 and paper roller 9 as given in FIG. 6 are posited in the down position, wherein paper roller 9 touches sheet of paper emplaced in the copy holder; paper retention bar 8' and paper roller 9' are positioned in the up position wherein paper roller stands free of contact with the sheet of paper. Said paper retention bar and said paper roller may be brought to rest at any position between the up position and the down position. Metal trims 27, FIGS. 4 and 6, are affixed to hood 5 at the left front edge and at the right front edge of said hood. In Third, Fifth and Seventh Embodiments paper retention bar 231, FIG. 23, and paper roller 232, in down position, may be moved to up position, FIG. 24, or be brought to rest at any point between the two positions. Trims 27 are affixed to hood 74, FIG. 47, at the left front edge and at right front edge of hood.

In First, Second, Fourth and Sixth Embodiments plastic fan platform arm 47, FIG. 4, is affixed to plastic fan platform 48. In Third, Fifth and Seventh Embodiments plastic fan platform arm 88, FIG, 27, is affixed to plastic fan platform 48. For such bonds, one of the new plastic welding processes, some of which use plastic electrodes, may be employed; application of one of the new adhesive cements is preferred; a suitable product is Eastman 910, a compound containing methyl 2 cyanoacrylate and a thickening agent.

Figure 7:
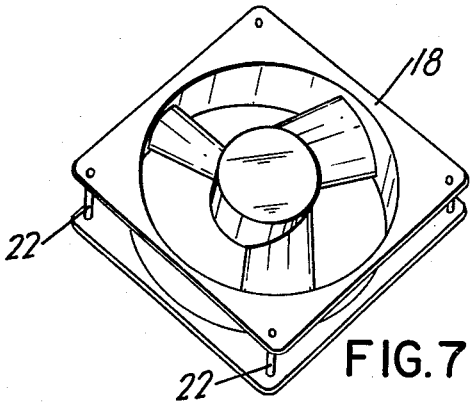
FIG. 7 is perspective of thermal instrument fan in all Embodiments.

In all embodiments, thermal switch 19, FIG. 4, designed for the copy holder, activates instrument fan 18, which is secured by fan bolts 22, FIG. 7, and nuts 20, FIG. 4, in the event that the temperature within the upper interior of the copy holder should reach a level regarded as undesirable. Instrument fan 18 adds an air flow to that of convection, attracting air from the left-hand side of the copy holder and ejecting it to the right-hand side. Air enters through metal intake grille 23, FIG. 8, and exits through metal exhaust grille 11 directly above instrument fan 18, FIG. 4. Exhaust grille 11, FIG. 3, and mock grille 12 are manufactured as a single component, grillwork 25.

Figure 3:
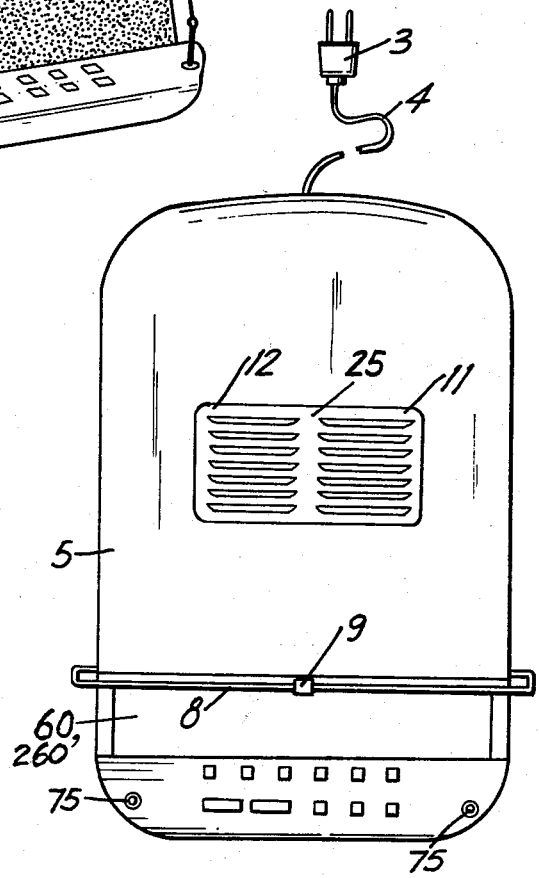
FIG. 3 is top view of copy holder in First, Second, Fourth and Sixth Embodiments.

In First, Second, Fourth and Sixth Embodiments grillwork 25, FIG. 3 is mounted from inside hood 5 to the inner surface of hood 5 beneath, and centered upon, a single rectangular aperture, smaller than grillwork 25, cut in the top of said hood. Adhesive cement binds the borders of the top side of grillwork 25 to a portion of the inner surface of hood 5 bordering upon said aperture in hood 5.

In Third, Fifth and Seventh Embodiments grillwork 25 is mounted from inside hood 74, FIG. 47, to the inner surface of hood 74 beneath, and centered upon, a single rectangular aperture, smaller than grillwork 25, cut in the top of said hood. Adhesive cement binds the borders of the top side of grillwork 25 to a portion of the inner surface of hood 74 bordering upon said aperture in hood 74.

In First, Second, Fourth and Sixth Embodiments base 45, FIGS. 4, 11 and 20, of heavy sheet metal and of a round cornered rectangularlike shape, is curved upward at the front end beneath console cover 6. Base 45 supports plastic framework 80, which comprises left upright 39 and righthand upright 40, bottom beam 49, top beam 44 and fan platform arm 47. Said uprights 39 and 49 are embedded, respectively, in recesses in base 45 and cemented into place. Bottom beam 49 and top beam 44 are affixed to left upright 39 and righthand upright 40. Circuit board 69, FIG. 4, is affixed to the top of base 45, and flat thin top mat 14, of hard rubber or rubberlike compound, is affixed to the bottom of said base. Hood 5 is attached to the back and side edges of base 45 with screws; said hood covers the edges of base 45, the top mat 14. Console cover 6 is snap fitted tightly to base 45.

Bottom mat 17 may be interlocked with top mat 14; in an alternate arrangement, wedge shaped first tilt mat 15 may be interlocked with top mat 14 and with bottom mat 17; in a second alternate arrangement, second tilt mat 16 may be interlocked with first tilt mat 15 and with bottom mat 17. To illustrate this disclosure, two wedge shaped mats, first tilt mat 15 and second tilt mat 16 are used. Any reasonable number of mats of any reasonable thickness may be used.

Figure 5:
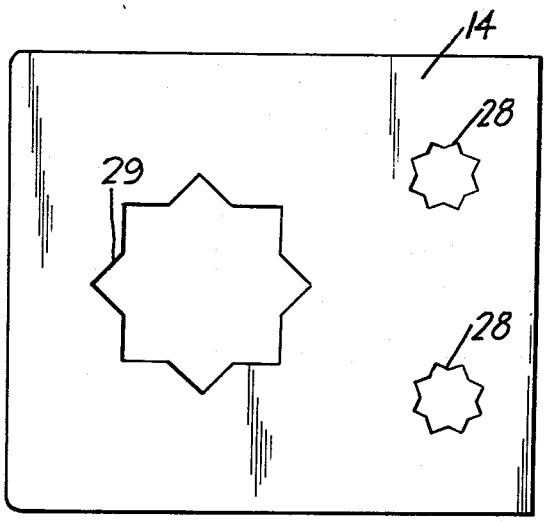
FIG. 5 is top view of top mat in all Embodiments.

Top mat 14, FIGS. 4 and 5, is perforated with three apertures shaped as sixteen-sided regular polygons; the exposed edges of top mat 14 which surround the apertures constitute three interlockers 29 and 28. Three shallow prongs in first tilt mat 15, the flat tips of which extend upward from said first tilt mat, fit snugly into the three recesses formed by interlockers 29 and 28 of top mat 14, and touch base 45. Three prongs at top of second tilt mat 16, identical to the prongs of first tilt mat 15, fit snugly into three recesses at bottom of first tilt mat 15, said recesses of first tilt mat 15 being identical in size and shape to the three interlockers 29 and 28 of top mat 14. Three prongs at top of bottom mat 17, identical to the prongs of first tilt mat 15 and second tilt mat 16, fit snugly into three recesses at bottom of second tilt mat 16, said recesses of second tilt mat 16 being identical in size and shape to the three recesses at bottom of first tilt mat 15.

Equilaterally symmetrical interlocker 29 of top mat 14 is centered upon the longitudinal axis of said top mat. Interlockers 28 of top mat 14 are equidistant from said longitudinal axis. The back corner and the front corner of interlocker 29 establish the location of cylindrical arcs centered upon the whole of the front edge of top mat 14; the edges of interlocker 29 of top mat 14 follow the curvature of these two arcs and of all concentric arcs between them. The edges of the corresponding prongs and recesses of first tilt mat 15 and of second tilt mat 16 also follow such arcs. The back and front corners of each of the two interlockers 28 of top mat 14 establish two cylindrical arcs concentric with the corresponding arcs established for interlocker 29 of top mat 14; the edges of the corresponding prongs and recesses of first tilt mat 15 and of second tilt mat 16, and the prongs of bottom mat 17 follow the curvature of these two arcs and of all concentric arcs between them. It should be stated that the front edges of top mat 14, first tilt mat 15, second tilt mat 16 and bottom mat 17 coincide.

Any reasonable number of prongs and recesses of any defined shape, size, location and orientation may be specified, instead of the three sixteen-sided regular polygons shown, for top mat 14, first tilt mat 15, second tilt mat 16 and bottom mat 17.

Several physical structurings of the copy holder in its Third, Fifth and Seventh Embodiments, illustrated in FIGS. 23, 24, 27 and 47, differ from counterparts in the First, Second, Fourth and Sixth Embodiments in that they are wider. These wider structurings in the Third, Fifth and Seventh Embodiments are hood 74, the longer paper retention bar 231 and top framing 261, face plate 87, console cover 13, base 84; the framework 85 comprising bottom beam 82, left upright 90, righthand upright 81, top beam 83, wedge 89 and longer fan platform arm 88; partition 43; top mat 234, first tilt mat 235, second tilt mat 236, and bottom mat 237. Each of these structurings have names and perform functions identical to the corresponding structurings of First, Second, Fourth and Sixth Embodiments. All corresponding structurings of each embodiment of the invention are assembled in the same way; counterpart structures differ only in lateral dimension.

The light shielding assembly of Third, Fifth and Seventh Embodiments, FIGS. 23, 25, 26 and 47, constitutes the only structuring unrepresented in First, Second, Fourth and Sixth Embodiments, said shielding assembly comprising left shield 76, right shield 77, top shield 78, left end shield 86 and right end shield 80, all of plastic. Left end shield 86 and right end shield 80 are cemented respectively to lower end of left shield 76 and to lower end of right shield 77. Left shield 76 and right shield 77 are affixed to hood 74 along the left and right edges, respectively, of said hood. Of a smaller depth than left shield 76 and right shield 77, top shield 78 is bonded to the forward half of the upper end of left shield 76 and right shield 77.

Removable face plate 60, in First, Fourth and Sixth Embodiments, FIGS. 3, 18 and 19, and in Second Embodiment face plate 260, FIG. 21, said face plate 260 being identical to face plate 60 in configuration and dimension, are supported by bottom beam 49, FIG. 11; said face plates are secured by top beam 83, FIG. 27, and by top framing 26, FIGS. 4 and 18, and are cushioned by pad 54, FIG. 18, a strip of spongy plastic such as that used in weather stripping, affixed by adhesive to bottom edge of said face plates. Face plate 260 is uncolored; this will be explained. Face plate 60 preferably is a sheet of clear translucent plastic with a translucent coating of a yellow color of medium intensity, said yellow color registering a spectral energy black body locus of 580 nanometers on C.I.E. chromaticity diagram, charted at values of 0.45 on the x axis and of 0.458 on the y axis of said chromaticity diagram; this color gives a chromaticity, hue and purity providing optimum display contrast of the characters of the inscription on a white document page with the background on which they appear as observed by the operator, with intensity of illumination adjusted to the personal preference of said operator. Other colors applied in coating or in mixing pigments with the plastic during manufacture, and uncolored sheeting, are not excluded from use in face plate 60 and its counterpart face plate 87, FIG. 23, said face plate 87 being used in the Third, Fifth and Seventh Embodiments; for face plate 87, which is used in front lighting, the color indicated for face plate 60 is preferred. A use of glass as the material of which said face plates are made is not excluded.

In the First, Fourth and Sixth Embodiments face plate 60, FIG. 18, and in the Second Embodiment face plate 260, FIG. 21, support left framing 61 and right framing 62, said framings being affixed to said face plates with a bond. Face plate 60 and face plate 260 are provided with two areas 63 of each of said face plates, said areas 63 being recessed to accommodate left framing 61 and right framing 62. FIG. 18 shows left framing 61 in place upon recessed area of face plate 60; FIG. 18 also shows right framing 62 moved to expose recessed area 63 of said face plate. Snap fitted top framing 26 is shown moved from place to expose recessed area 64 of face plate 60 and recessed area of hood 5, said recessed areas being designed to receive, respectively, the bottom half of removable top framing 26 and the top half of top framing 26. Face plate 260 is recessed and framed identically.

In the Third, Fifth and Seventh Embodiments a recessed area of face plate 87, FIG. 23, and a recessed area of hood 74 accommodate removable top framing 261. The left framing 61 and right framing 62 of the First, Second, Fourth and Sixth Embodiments, designed for use in those four embodiments only, are not used in Third, Fifth and Seventh Embodiments.

It is noted that in the First, Second, Fourth and Sixth Embodiments the four mats, FIG. 4, top mat 14, which is affixed to base 45, first tilt mat 15, second tilt mat 16 and bottom mat 17 perform dual functions; said mats provide the copy holder with both a means of maintaining stability of footing and a means whereby the operator may tilt the copy holder, selecting an inclination which provides the individual operator with a line of sight suitable for viewing an inscribed document page emplaced upon the copy holder for processing. In the Third, Fourth and Seventh Embodiments top mat 234, FIG. 47, first tilt mat 235, second tilt mat 236, and bottom mat 237 perform said dual functions. On this subject of stability it is further noted that the copy holder is of noncollapsing construction; the copy holder in its present design is compact; it is of such size over all that the desk space it occupies in use approximates the area of a document page in common office use. In the First, Second, Fourth and Sixth Embodiments the copy holder is housed by hood 5, FIG. 2, console cover 6 and metal base 45, FIG. 4; in the Third, Fifth and Seventh Embodiments it is housed by hood 74, FIG. 47, console cover 13 and metal base 84. Said hoods and console covers are of rigid composition; said metal bases invest the copy holder with a low center of gravity.

From this point the power, control and display systems, and the place keeping functions, of the seven embodiments of the sequentially highlighting copy holder will be described.

In all embodiments on-switch 95, to which reference is made in all control circuitry drawings and in all console drawings, is closed, FIGS. 29 and 33, by the operator of the copy holder. A document page is dropped against face plate 60, FIG. 3, and down between paper sensor 66 and console cover lip 67, FIG. 20, said page now being supported at the bottom by console cover lip 67, said console cover lip being coated with flat black on its back surface. This place of rest for the document page is open at each side of the copy holder, as seen in FIGS. 2 and 4, in First, Second, Fourth and Sixth Embodiments; console cover lip 258, FIG. 47, supports said document page in Third, Fifth and Seventh Embodiments, the place of rest being open at each side in all embodiments. In the event that the margining of said document page is lopsided, with a portion of the inscription encroaching close to the edge of the sheet, operator may insert the page into said copy holder in an off center position, with one vertical border protruding from the copy holder. During the processing of a document page, operator may shift the stationary page; in the First, Second, Fourth and Sixth Embodiments paper retention bar 8, FIGS. 4 and 6, is positioned so that the upper portion is free to be moved; in the Third, Fifth and Seventh Embodiments paper retention bar 231, FIGS. 23 and 24, is so positioned; operator may shift page left and right, viewing any marginal inscription. Thus, said page is secured at top, with paper retention bar lying close to it, and secured at bottom by said console cover lip without any fastening procedure being needed.

The two acts of closing said on-switch 95 and placing a reflective object before paper sensor 66, performed in either sequence, activate the circuitry of the invention. Of reflective object sensors available, new OPB 709, combining a solution grown gallium arsenide infrared LED with a photodarlington, a product of TRW Optron, Carrollton, Texas, is acceptable. Paper sensor 66 is bonded to bottom beam 49, FIGS. 11, 19 and 20, with face of said paper sensor slightly removed backward from the front edge of said bottom beam, in First, Second, Fourth and Sixth Embodiments. Paper sensor 66 is so bonded to bottom beam 82, FIG. 27, in Third, Fifth and Seventh Embodiments. Description of electronic circuitry of First, Second and Third Embodiments follows.

FIG. 29, a block diagram of the power and control systems of the First, Second and Third Embodiments, shows a connection, with on-switch 95, of circuitry to utility power source; a data processing system containing nonvolatile programmed memory capable of interfacing inputs from microprocessor console 115 and keyboard sensors 71 and 241; and outputs to the display systems of the three embodiments, FIGS. 30, 31 and 32. The control system accommodates a CPU (central processing unit) 100, mask programmed ROM (Read Only Memory) 107 and ROM 108, input-output devices 113 and 114, microprocessor console 115, display driver 112, keyboard sensor 71, and paper sensor 66.

ROMs 107 and 108 interface with common data bus 110 and, via data lines 105, with CPU 100, address bus 111 and control bus 109 by means of data buffer 103 and signal lines A0, A1 . . . A15; and with control lines 104. Crystal oscillator 101, which supplies clocking signals Ø1 and Ø2, and control latches 106 with control lines 105 are instrumental in effecting the interfacing and operation of CPU 100 with the components and buses just indicated. Clocking signal Ø1 is applied to logic gate 99 to synchronize clock pulse train Ø1 with the signals from data bus 110 and control bus 109.

ROMs 107 and 108 provide the program steps of CPU 100, with power supplied by regulated power supply 97. When energized by the closing of on-switch 95 and the arrival of a ready signal from paper sensor 66, the microprocessor system, termed "microprocessor" hereinafter, will accept commands from microprocessor console 115, FIGS. 29 and 33. On-switch 95 and the other twelve electronic control switches are activated manually from console 115.

In the display system of the First Embodiment ac power is applied via lines 96, FIGS. 29 and 30, to full wave rectifier bridge 116; the dc output of said rectifier is made available to lamps 36. When the operator selects a place keeping function by striking the momentary contact switch labelled with the name of that function on console 115, FIG. 33, a pulse train is supplied from the individual outputs G1 . . . G14 of display driver 112 to G1 . . . G2 of SCRs 118, said pulse train turning on corresponding lamps 36, said lamps being the topmost two lamps 36 in the battery of lamps 36, FIGS. 10 and 12, said battery of lamps 36 constituting the light emission element of this First Embodiment.

Any reasonable number of lamps may be used; for the purpose of illustrating this disclosure, the battery comprises 14 lamps. Lamp 36 is a frosted tubular incandescent lamp comprising cylindrical steel terminal 37 attached to spring clips 38 riveted to uprights 39 and 40 of plastic framework 80, FIG. 22, said uprights being secured by base 45 and top beam 44; tungsten filament 41; and, supporting said filament, quartz support disk 42. A plastic reflector 70, FIGS. 10, 12 and 20, encloses each lamp 36 at top, back and bottom, said reflector being, in the curved portion, a parabolic specular reflector, with the front portion from the curved portion forward to the front of the reflector straight, and nonreflective. The 14 reflectors 70 may be extruded as one piece; FIG. 20 shows the preferred construction, wherein each reflector is manufactured as a single piece; each of the bottom 13 reflectors is bonded at its upper edge to the bottom of the reflector above it. The top reflector 70, FIGS. 10 and 12, is made with a full top extending, like the bottoms of all the reflectors, to a point close to face plate 60. The reflectors are supported by the top of bottom beam 49, FIG. 20, and by plastic pegs 46, FIG. 11, embedded into and bonded to left upright and right-hand uprights 39 and 40, said pegs 46 positioned so that the bottom curved portions of the third, seventh and eleventh reflectors meet the tops of the three said pegs 46 and are bonded to said pegs. Reflectors 70 are open at each end.

At a touch of the place keeping Descend switch 123, FIG. 33, the programming and electronic circuitry described for this First Embodiment and presented in FIGS. 29, 30 and 33, apply power to top lamp 36 and second lamp 36, which is positioned just below top lamp, FIG. 12; said top lamp is energized at full value of the median of the upper and lower limits of brightness set by the programming of the microprocessor; said second lamp, beginning at one-half the brightness of the first lamp, commences imperceptibly to brighten further, toward full brightness, while the first lamp remains lighted at full value.

In this First Embodiment, and in the other two embodiments controlled by the microprocessor, which are the Second and Third Embodiments, control of the intensity of luminance produced by the light emission elements of the respective three embodiments is exercised by the microprocessor and circuitry in activating, increasing, decreasing and deactivating the length of the pulse train applied to each gate G1, G2 . . . G14, FIG. 30, of the individual SCRs (silicon controlled rectifiers) 116, thereby activating and deactivating, and increasing and decreasing the firing angle of said SCRs. Control of the time span of the page cycle represented by activation of all 14 lamps in sequence is exercised by the timing of the application of the pulse trains to specific terminals G1, G2 . . . G14.

In the Descend function, with top lamp 36 activated and emitting full established intensity, and with second lamp 36 brightening, the operator may change the intensity over all by tapping or holding down either end of Brt/Dim (brighten/dim) rocker switch 128, FIG. 33, until the desired intensity of lighting of a portion of the document page is reached.

At the moment when second lamp 36 has brightened to the full value of intensity, first lamp 36 begins imperceptibly to dim; at that same moment third lamp 36 is activated and starts to brighten imperceptibly. The place keeping Descend function continues in this manner, with three lamps 36 lighted from the acquisition of full intensity of luminance by second lamp 36 until bottom lamp 36 has been fully lighted for the same term through which each of the 13 lamps above said bottom lamp were fully lighted. At that point the page cycle is ended. Through the page cycle, the first lamp of the three lamps activated at any one moment is dimming from full brightness toward zero brightness, the second lamp is shining at the full value of brightness, and the luminosity of the third lamp is growing from zero toward full value. Total luminance produced by the first and third lamps 36 continuously equals the luminance produced by the full lighted center lamp 36 over any given period. At the end of the page cycle, the top lamp again is activated at full value, and second lamp 36 begins to brighten from half brightness as the next page cycle is initiated. This instantaneous cycle succession is broken in the event that the document page is removed from its position before paper sensor 66, FIG. 29. Upon replacement of a reflective object into the field of view of said paper sensor, the page cycle of place keeping Descend function is recommenced without regard to the point at which said page cycle was interrupted.

Figure 1:
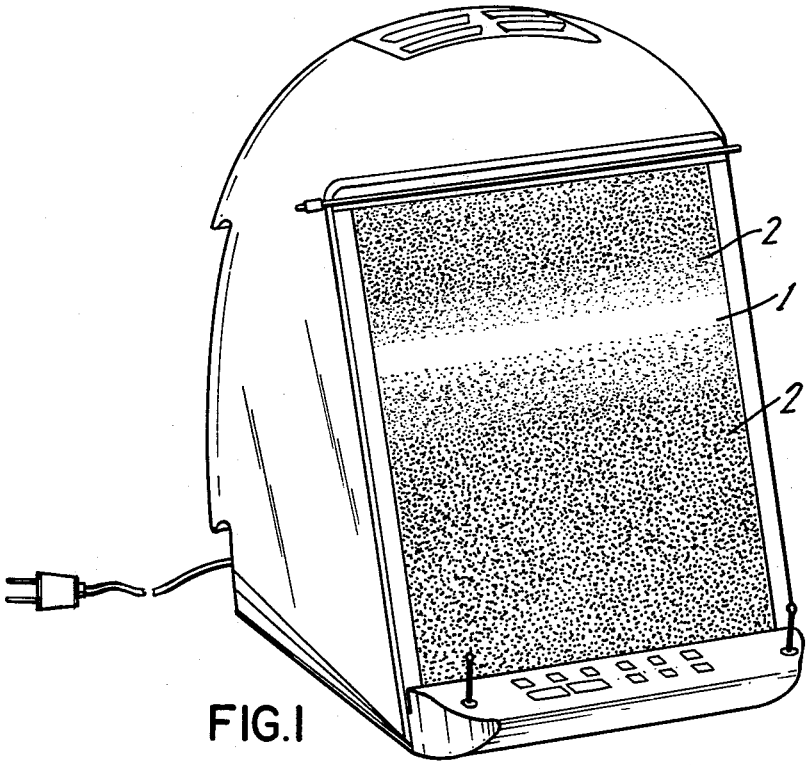

The perceived effect, that of a single field of light proceeding down the back lighted document page emplaced on the copy holder as the Descend function progresses, is illustrated in FIG. 1. Unilluminated areas of the translucent face plate 60, which has been drawn without a document page in place, for the purpose of illustration, said areas being designated areas 2, lie above and below the area in front of the fourth, fifth and sixth lamps 36, said area being designated as lighted area 1. Area 1 is composed of a top third partially lighted, a center third fully lighted, and a bottom third partially lighted. The top third of area 1, the zone before fourth lamp 36, FIGS. 1 and 12, is lighted in FIG. 1 at approximately one-third of full intensity; the center zone, before fifth lamp 36, is fully lighted; and the zone before sixth lamp 36 is lighted at approximately two-thirds intensity. Fourth lamp 36 is dimming and sixth lamp 36 is brightening as the center of the perceived field of illumination descends face plate 60.

Such downward movement of the illuminated area of an emplaced document is diagrammed in FIGS. 14 and 15, wherein the reference characters of FIG. 1 are used. FIG. 14, comprising upper zone receiving dimming light from third lamp 36, center zone fully lighted by fourth lamp 36, and lower zone receiving brightening light from fifth lamp 36, represents the position of activated lamps 36 as execution of the fourth segment cycle is in progress. Areas 2 are unilluminated. FIG. 15, with unhighlighted areas 2' above and below lighted area 1', shows that in the fifth segment cycle the center of perceived illumination has descended by the same distance as that from the longitudinal axis of one lamp 36 to that of the next.

At any time, the operator may alter the rate at which the page cycle is executed. Available speeds extend from those of several seconds per page to those of several hours per page. To depart from the programmed speed, the operator taps or holds the appropriate end of rocker Fast/Slow switch 129, FIG. 33, changing the timing of application of the pulse trains to terminals G1, G2 . . . G14, FIG. 30. The chosen speed remains operative until it is changed or on-switch 95, FIG. 33, is released.

The vertical dimension of the illuminated field may be increased at any time. The operator presses Large Field lock switch 130, FIG. 33, to add a second fully lighted lamp 36 below the fully lighted lamp 36 already operative. Thus each segment cycle is executed by activation of four lamps 36 at any one time, with top lamp 36 of the cycle fading, second and third lamps 36 emitting luminance at the full, and fourth lamp 36 becoming brighter. Programming may provide for any reasonable number of fully lighted lamps 36 to be added to the segment cycle of Large Field place keeping function; one such fully lighted lamp 36 is preferred. Programming may provide for any reasonable number of dimming and brightening lamps within the segment cycle; provision for one dimming lamp and one brightening lamp is preferred. To deactivate the Large Field function, the operator releases Large Field lock switch 130, and the regularly illuminated field returns, with full brightness from the third lamp 36 replaced by the brightening of said lamp within the contexture of the regular segment cycle. Fourth lamp 36, now dark, will remain so until first lamp 36 has dimmed out. At such time Fourth lamp 36 will begin to brighten.

Augmenting the control of the rate at which the segment cycles, and therefore the page cycles, are executed, the operator may press Double Speed lock switch 131, FIG. 33, at any time. Other reasonable degress of acceleration may be provided in this function instead; the degree of acceleration which halves the time span through which each segment cycle is executed stands as the preference. Operator may deactivate the Double Speed place keeping function by releasing Double Speed lock switch 131.

The operator may arrest the movement of the illuminated field by pressing Pause lock switch 132, FIG. 33. Activated lamps remain as they are at that moment, with the programmed changing of the field of light halted. The illuminated field remains motionless until Pause switch 132 is released. To terminate operation of the Descend function, momentary contact Step switch 125, or momentary contact switches Stride function switch 124, Sectional function switch 126 or Keyboard function switch 127 may be used.

Stride place keeping function is diagrammed in FIGS. 16 and 17. Upon activation of momentary contact Stride switch 124, FIG. 33, first and second lamps 36 are lighted at the intensity established by the programming and modified, after activation of the circuitry, by the operator. Programmed timing as modified by the operator also remains in effect in a change from Descend function to Stride function, or from Stride function to Descend function.

In the Stride function, as in the Descend place keeping function, when the timing calls for a change in the limits of the area highlighted by first and second lamps 36, a new segment cycle is entered. First lamp 36 dims out in approximately two seconds, in the Stride function, as third lamp 36 fades in simultaneously over the same short period to full established brightness. When the start of the third segment is signaled, second lamp 36 dims out quickly as fourth lamp 36 quickly brightens to the full intensity; third lamp 36 remains fully lighted. FIG. 16 diagrams this third segment cycle; lighted zone of the emplaced document page is represented by area 58; behind said area 58, third and fourth lamps 36 are fully lighted; second lamp 36, behind unlighted area 59 of the inscription, has dimmed out quickly from full brightness as fourth lamp quickly brightened; area 59' represents unilluminated areas of the document page. FIG. 17 diagrams the fourth segment cycle; third lamp 36, corresponding to document page area 59', has dimmed out as fifth lamp 36 brightened; area 58' represents area of document page which is illuminated. Said area 58' overlaps the position which was occupied by the area 58 field of light in FIG. 16.

The Stride place keeping function produces a traversing by a field of light down the length of an inscribed sheet of paper in leapfrog fashion, with one position of the field of light overlapped by the next. The microprocessor times and controls a sequential change of the vertical position of said field of light through each segment cycle; the fields of illumination extend from side to side of the operative portion of the inscribed sheet. The page cycle ends when bottom lamp 36, FIG. 20, has emitted light at the full established intensity for as long a period as have the lamps above bottom lamp 36 during the page cycle. The operator may depart the Stride function by touching one of the basic microprocessor place keeping function switches, FIG. 33, Descend function switch 123, Step function switch 125, Sectional function switch 126, or Keyboard function switch 127; or by releasing lock on-switch 95.

When the document page is removed, deactivating the circuits, and a page replaces it within the field of view of paper sensor 66, FIGS. 19 and 20, the circuitry is reactivated at the start of a page cycle of the function corresponding to the function switch, from the four such switches just named, which was used in terminating the Stride function. In operation of the Stride function, the Pause lock switch 132, FIG. 33, may be used and released, and Advance switch 75 may be used, in keeping the place in the text within the field of light.

Figure 9:
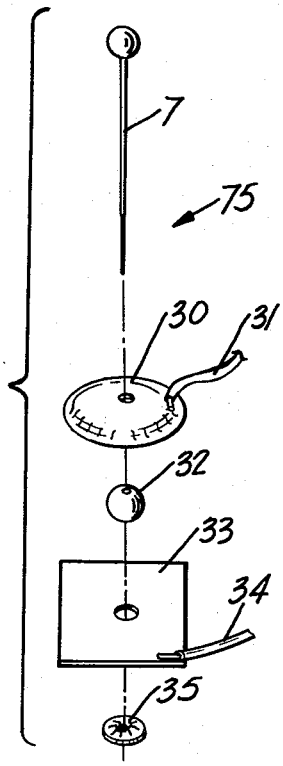
FIG. 9 is exploded drawing of Advance switch in First, Second, Third, Fourth and Fifth Embodiments.

The Step place keeping function resembles the Stride function in that fully lighted areas are moved in leapfrog overlapping fashion down the face of the inscription on the document page in a sequential lighting of the inscription. That the Step function shift from one segment cycle to the next is signalled manually constitutes the only difference between the operation of the Step function and that of the Stride function wherein the microprocessor times such shifts. This manually activated shifting from segment to overlapping segment in the Step function is accomplished by use of one of the two upright Advance switches 75 situated near the left and right edges of console 115, FIG. 33. Advance switch 75, FIG. 9, comprises lever 7, of vinyl, which is identified in FIGS. 2, 3, 4, 33, 34, 36, 37 and 47 by the reference character of the entire Advance switch 75 itself; copper upper contact 30; upper signal wire 31; vinyl spacer 32; copper lower contact 33; lower signal wire 34; and steel lock washer 35. A touch of omnidirectional lever 7 brings upper contact 30 into contact with lower contact 33, activating Advance switch 75.

At the start of the application of the Step function which, in addition to the Stride function, is diagrammed in FIGS. 16 and 17, the first and second lamps 36 are fully lighted. At the touch of either of the Advance switches 75, first lamp 36 fades out in approximately two seconds as third lamp 36 changes simultaneously from inactivation to full brightness; second lamp 36 remains fully lighted. At each closing of an Advance switch 75, the fully lighted area moves downward by one segment cycle. Thus, when the third segment cycle is reached, as in FIG. 16, second lamp 36, behind area 59, has been extinguished quickly and the fourth lamp 36 has brightened quickly to join third lamp 36 in fully lighting area 58 of the inscription. At the next activation of Advance switch 75, third lamp 36, area 59', FIG. 17, has gone out and fifth lamp 36 has brightened to full intensity, joining fourth lamp 36 in lighting area 58'. In the final segment cycle, bottom lamp remains casting light on the document inscription until the next striking of an Advance switch 75 or the removal of the document page has been accomplished. Whether the page is left in place or is replaced by another document page positioned before paper sensor 66, FIG. 20, the page cycle begins anew with first and second lamps 36 fully on. In the event that the page is kept in place, the next use of Advance switch 75 begins the new cycle.

Large Field switch 130, FIG. 33, may be used in Step function. Activation and release of Pause switch 132 would be redundant; Double Speed switch 131 is inoperative. Step function is abandoned by activating Descend switch 123, Stride switch 124, Sectional switch 126, keyboard switch 127, or by releasing lock on-switch 95.

In the Descend function circuitry, Stride function circuitry, and the two Keyboard function circuitries soon to be described, Advance switch 75 is used to interrupt the microprocessor programming at any stage of the work, and advance the field of light by one segment cycle exactly, from the point to which the segment cycle has progressed at the moment of activation of the Advance switch to the same point in the next segment cycle. Tapping Advance switch 75 repeatedly brings the field of light quickly down through the page cycle and into the next page cycle. Following the momentary closing of Advance switch 75 and the advancing of the field of light by one segment cycle, the microprocessor resumes its function of timing and controlling the completion of segment cycles in turn until Advance switch 75 again is closed, Pause switch 132 is activated, or the basic place keeping function is changed.

In the two Keyboard place keeping functions, each of which is begun by activating momentary contact keyboard switch 127, FIG. 33, the microprocessor counts, and temporarily stores a running tabulation of, the quantities of input being placed by the operator into the keyboard machine as the document page inserted in the copy holder is being processed. The microprocessor uses the data produced by said tabulation to time the activation, brightening, dimming and deactivation of illumination from lamps 36, FIG. 30, in performing the Descend function as the means through which the field of light is advanced in the performance of the two Keyboard place keeping functions. The use of said data effects a synchronization of the rate of movement of the field of light with the rate at which text lines are put into the keyboard machine in such document processing operations as those most commonly engaged in, transcribing and editing, and excerpting from the documents processed.

To accomplish this synchronization, the vertical dimension of the portion of the inscription served by a single segment cycle of the Descend function, FIGS. 14 and 15, is related to the number of lines produced by the input into the keyboard machine. Virtually all word processing input machines and typewriters currently produced are standardized in this respect at six single spaced lines per vertical inch. The preferred number of light emission elements from top to bottom of the area to be highlighted dictates that the vertical dimension of the zone lighted by each segment cycle accommodate approximately four single spaced lines. In the First Keyboard function, soon to be described, the microprocessor is programmed to command activation of a new segment cycle upon receipt of encoded position signals representing a specific quantity of input entered into the keyboard machine; said quantity of input may be measured in a variety of ways encompassing great scope, including mere tabulation of the number of lines entered; said quantity of input approximates four lines of the text of the inscription on the document page installed in the copy holder of the present disclosure, a copy holder equipped with 14 light emission elements, lamps 36, FIG. 12; the set of encoded position signals dispatched by the keyboard machine may produce any reasonable number of pulses which call for a change of illumination from one segment cycle to the next so long as the number of said pulses is identical in all transmissions; four such pulses are preferred. In the Second Keyboard function of the copy holder in this disclosure, on the other hand, the preferred number of signals in the set of encoded position signals is four, and the preferred number of pulses calling for a change of illumination from one segment cycle to the next is four also.

Basic microprocessor First Keyboard place keeping function employs data entering the microprocessor from the first keyboard sensor 71, FIGS. 13 and 33, which comprises lead 239, plug 57 and jack 68, FIGS. 19 and 20. Lead 239 is connected directly to the keyboard machine and to plug 57, said plug 57 being inserted into jack 68. The keyboard machine is a member of one of the general classes of keyboard machines, said class comprising data processing input machines and word processing input machines; keyboard machine is positioned at the copy holder work station. Said data are sets of encoded position signals transmitted from first keyboard sensor 71 to the microprocessor of the copy holder, each set of signals representing a quantity of input entered into said keyboard machine by the operator, said microprocessor storing said signals, each set of signals being correlated with the vertical distance traveled by the longitudinal center of intensity of the field of light down the inscription on a document page in one segment cycle, said longitudinal center being positioned laterally across a portion of the inscription. The microprocessor, upon receipt of the final signal of the set of encoded position signals, translates the set into a command that a segment cycle of the light emission elements be performed. The microprocessor purges the storage of signals and begins to count signals anew. Implementation of successive sgement cycles effects a movement of the field of light down the inscription as the operator holds the place in processing the document page. The performance of said First Keyboard place keeping function progresses, subject to use, by the operator, of microprocessor Advance and Pause functions activated respectively by Advance switch 75, FIG. 33, and Pause switch 132, which are performed in the way said functions are performed in the basic Descend function alone. Said Advance and Pause functions are used in nullifying the appearance of any noticeable departure from synchronization of the movement of said field of light and the movement of the place of attention in the text as the operator processes the document page. The Descend Large Field function provides a second fully lighted lamp 36, FIG. 12, directly below the fully lighted lamp 36 already operative; the Large Field function is entered when operator presses Large Field lock switch 130, FIG. 33. The Double Speed function is entered when operator presses Double Speed lock switch 131. Employment of the Large Field and Double Speed functions simultaneously is indicated when the operator is engaged in the common practice of processing double spaced draft versions of documents. In working with source document pages which have been given single and one-half spacing or triple spacing and with hand written pages, the operator may restore synchronization of the rate of descent of the field of light with the input of text into the keyboard by use of the rate change function, performed when the operator taps or holds down for a short period either end of rocker switch 129, FIG. 33. This Fast/Slow switch 129 remains operative whether the Double Speed function is activated or inactivated. Performance of the First Keyboard function is terminated when lead 239, FIGS. 13 and 33, is disconnected from the keyboard machine, plug 57 is removed from jack 68, or the basic place keeping function is changed.

Basic microprocessor Second Keyboard place keeping function employs second keyboard sensor 241, FIGS. 13, 29 and 33. Pad 50, FIGS. 13 and 33, transmits a series of signals through lead 253, plug 57 and jack 68 to microprocessor. Pad 50 comprises thin mylar tape insulators 51 at top and bottom of said pad; small thin fulcrum 52 of soft plastic in the center; thin copper conductors 55 immediately above and below fulcrum; and the two terminals of lead 253. The five component layers are aligned at the respective ends where the two terminals are affixed, and are bonded permanently, one layer with the next, by adhesive. Plug 57 is inserted in jack 68, and lead 253 is disposed on the work surface so that pad 50 may be secured to the top of the return key which, on word processing input machines, is known also as the line return key and, on typewriters and word processing input machines provided with moving carriers, is known also as the carrier return key. Said pad 50 is secured temporarily to the return key by means of a coating of pressure sensitive adhesive on the bottom of the pad, said coating being applied in manufacture. Copy holder is equipped with two plugs 57, one attached to lead 239, said plug 57 and lead 239 forming first keyboard sensor 71 for use in the First Keyboard function, and the other plug 57 attached to lead 253, which is connected to pad 50, forming second keyboard sensor 241 for use in the Second Keyboard function. In the performance of the Second Keyboard function, as in the First Keyboard function, the basic microprocessor Descend place keeping function is employed for movement of the field of light as the inscription on the document page is processed. The center portion of lead 239 and the center portion of lead 253 are made tacky, in manufacture, by the application of a thin light adhesive coating which holds the lead temporarily in position against the work surface, out of the way of the operator during use of either First or Second Keyboard function. The keyboard machine, to the return key of which pad 50 is affixed, is a member of one of the general classes of standard keyboard machines, said class comprising standard electric and manual typewriters, and standard word processing input machines, said standard word processing input machines in said class being operated with the return key in use during processing of document pages containing tabular matter, office forms, listings of names and addresses, and other source material presented in short lines of input. Sets of encoded position signals are transmitted, during the page cycle of the Second Keyboard function, from sensor 71 to the microprocessor, each set comprising a specific number of component signals, each component signal representing one line of text produced as input upon the standard keyboard machine, the number of input lines in each set of encoded position signals being correlated with the vertical distance traveled by the longitudinal center of intensity of the field of light down the inscription on a document page in one Second Keyboard segment cycle, said number of component signals being four, preferably, one being transmitted from second keyboard sensor to the microprocessor upon each use of said line return key of said standard keyboard machine. Each time the return key is struck, pressure exerted by a finger of the operator both completes the entry of a line of input into the keyboard machine and brings the two copper conductors 55 of pad 50 into contact, sending a signal for temporary storage in the microprocessor. Upon receipt of the fourth and final component signal in the first set of encoded position signals, said microprocessor translates the set of signals into a command that an initial segment cycle of the Second Keyboard function be performed, and upon receipt of succeeding sets of encoded position signals microprocessor commands succeeding implementations of Second Keyboard segment cycles. At the closing of each segment cycle, the microprocessor purges the pulse storage and begins to count and store pulses anew. The implementations of segment cycles effect a movement of the field of light down the inscription on the document page as the operator uses the boundaries of said field of light as a frame of reference in holding the place of work in processing said page. The execution of the page cycle, with attendant movement of the field of light downward, progresses subject to use of microprocessor Advance and Pause functions by activation of momentary contact Advance switch 75, FIG. 33, and Pause lock switch 132, said functions being performed in the way in which they are performed in the Descend function alone, said Advance and Pause functions being used in nullifying the appearance of any noticeable departure from synchronization of the movements of said field of light with the movement of the place of attention in the text as operator processes the document page. Application of the Second Keyboard function stands subject also to activation of Large Field function by the closing of Large Field lock switch 130, FIG. 33, and of Double Speed function by the closing of Double Speed lock switch 131. The rate change function, activated by use of Fast/Slow rocker switch 129, remains available during performance of the Second Keyboard function. That performance is terminated when pad 50 is removed from the return key of the keyboard machine. The operator may reinstate the Second Keyboard function by again installing pad 50 on the return key of the keyboard machine and, in the event that use of another basic place keeping function has intervened, touching keyboard switch 127. As in the First Keyboard function, the operator may use Fast/Slow switch 129 in the Second Keyboard function. The operator may wish to remove plug 57 from jack 68 upon terminating either the First or Second Keyboard function.

The Sectional place keeping function, the final basic microprocessor function, is entered by use of the momentary contact Sectional switch 126, FIG. 33. For special applications including short memoranda, office forms, invoices and orders being documented, source pages bearing needed information only on portions of the vertical extent of the pages, pages of formula computation, mailing lists, pages in such form that highlighting less than the entirety of said pages is indicated, and forms being processed in batches, small and large undivided fields of light are cast sequentially upon portions of the inscriptions on the document pages. Selection of the Sectional function is acknowledged by the appearance of a slender, rectangular, horizontally positioned zone of light shining steadily at the full established intensity upon the bottommost area of the inscription being processed, said bottommost area being back lighted by the fourteenth, the bottommost, lamp 36, FIG. 12. Selection of the area to be highlighted on a given document page is made by enlarging, reducing and repositioning the field of light until a suitable area is highlighted. The operator accomplishes this adjustment by use of the momentary contact microprocessor Sectional Advance switch 75, FIGS. 9 and 33. A flick of either of the Sectional Advance switches 75 produces the appearance of a second zone of light, the initial zone being joined by another slender, rectangular zone of light, the bottom edge of said zone of light coinciding with the top edge of the bottommost zone of light, the added zone of light being cast by the thirteenth lamp 36, FIG. 12. The operator uses the Sectional Advance switch to implement the Sectional function, changing the configuration of said field of light, highlighting all operative parts of the inscription on the page, encompassing them within the limits of said field of light by activating a lamp 36 immediately above those already activated, with each succeeding use made of Sectional Advance switch 75 extending the field of light upward until the sequential buildup of said field of light comprises illumination emitted from the bottom 13 lamps 36 of the 14 lamps. There the buildup is halted, with a highlighting of the whole area of the inscription lying below the topmost zone of said inscription. The next use of the Sectional Advance switch extinguishes all the lamps 36 which have been turned on, and simultaneously activates the topmost lamp 36, producing a zone of light highlighting only the topmost portion of said inscription. Succeeding uses of said switch enlarges the field of light downward until the Sectional page cycle is ended with all lamps 36 positioned above the bottommost lamp, the fourteenth lamp 36, activated and said field of light present upon all areas of the inscribed page above the bottommost area. Another flick of the Sectional Advance switch would start a new cycle, extinguishing the 13 lighted lamps 36 and activating the bottommost lamp. Thus, the full area of said inscription remains only partially lighted throughout the performance of the Sectional function. When the operator ceases the use of the Sectional Advance switch, the selected field of light remains stationary through the processing of the document page. The configuration of said field of light continues to be subject to change made by use of Sectional Advance function. The highlighting is extinguished upon removal of the document page from the copy holder; the size and positioning of the selected field of light is restored upon replacement of said page by another page, an event occurring only in the Sectional functions of all embodiments, said Sectional functions facilitating quick replacement of one page with another page of the same batch being processed. Activated lamps 36 emit the full established luminance; at any given instant one or more lamps 36 remain deactivated. The Sectional function is withdrawn by selection of another basic microprocessor place keeping function or by release of lock on-switch 95, FIG. 33.

The Second Embodiment of the copy holder performs the place keeping functions of the First Embodiment. Microprocessor power and control circuitry of FIG. 29 and display circuit of FIG. 31 illuminate a document page with a battery of LEDs (light emitting diodes) emplaced close to back surface of uncolored face plate 260, FIG. 21, a face plate identical in configuration and dimension to colored face plate 60, FIG. 3. Thirty-two rows of LEDs are mounted on printed circuit 73, FIG. 21, each row comprising 14 individual LEDs which are activated, brightened, dimmed and deactivated two rows at a time so that 16 LED sections 72 are used, each section comprising 28 LEDs, and appear in display circuitry FIG. 31 as 16 individual light emission elements, LED sections 72. The programming of ROMs 107 and 108 as used in the First and Third Embodiments to serve 14 light emission elements is modified in this Second Embodiment to serve the 16 light emission elements. Several available LEDs would provide favorable ratios of back lighting to light reflected from the front surface of the document page; the uniform brightness of the new MV57173 LED in yellow used with uncolored face plate 260 is suitable; said light emitting diode is manufactured by General Instrument, Optoelectronics Division, Palo Alto, Calif. Use of other LEDs is not excluded.

In the Second Embodiment, with on-switch 95 closed, FIG. 33, a document page mounted on the copy holder, and paper sensor 66, FIGS. 19 and 29, completing activation of the circuitry, dc power from regulated power supply 97 is made available through line 98, FIGS. 29 and 31, to the 16 LED sections 72. When pulse trains from display driver 112 are made available via G1 . . . G16 to the bases of individual transistors 120, said transistors activate individual LED sections 72. Control of brightness of LED sections 72 is exercised by increases, stabilization and decreases imparted to the length of the pulse train applied to each terminal G1, G2 . . . G15, G16 of individual transistors 120, FIG. 31. Control of the time span of the page cycle represented by sequential activation of all 16 LED sections 72 is exercised by timing of application of pulse trains to specific bases G1, G2 . . . G15, G16.

The Second Embodiment is operated by the methods and procedures used in operating the First Embodiment. The Second Embodiment, with 16 light emission elements, performs the same place keeping functions as those designated in the description of the First Embodiment with 14 light emission elements. Physical structurings of the copy holder in this Second Embodiment are those designated in the description of the First Embodiment.

The Third Embodiment of the copy holder, in the physical structurings of the embodiment, was described in the account given of the physical structurings of all embodiments, with reference being made to FIGS. 23, 24, 25, 26, 27, 28 and 47. Thereafter, in the account which completed the description of the First Embodiment, two nonstructural components common to the First, Second and Third Embodiments, Advance switch 75, FIG. 9, and the keyboard sensors 71, 241, FIGS. 13 and 33, were detailed. Power and control circuits of the First, Second and Third Embodiments, FIG. 29, have been described. The present account ends the description of the Third Embodiment with details of the display circuit, FIG. 32, and of the light emission elements. Whereas use was made of the cardinal translucence index of the paper stocks in common office use by emplacement of the light emission elements of the First and Second Embodiments behind the positioned document pages for bck lighting the inscriptions on said positioned pages, emplacement of the light emission elements of the Third Embodiment is made in front of the plane of the positioned document pages for front lighting of the inscriptions on said positioned pages.

With on-switch 95 closed, FIG. 33, and paper sensor 66, FIG. 29, having completed activation of the circuitry, dc power from regulated power supply 97 is made available through line 98, FIG. 32, to 14 pairs of series connected instrument type incandescent lamps 93, FIGS. 24 and 28. These light emission elements are arranged in two rows of identically constructed lamp assemblies 79, FIG. 28, occupying positions removed toward the operator from the plane of the document page in place on the copy holder, said light emission elements sequentially front lighting the inscription on said document page. Each lamp 93 is attached to socket 94, said socket being bonded to cradle 91, said cradle, FIG. 26, being engaged and cemented to surface of left upright 90, a member of framework 85, said surface being of the general shape of the free end of said cradle 91. Cylindrical socket 94 supports cylindrical reflector 92, which is coated flat black on the inner cylindrical wall; reflector 92 is tightly snap fitted at the annular base to the rim of the socket surrounding lamp 93; annular base of reflector 92 bears specular coating on the exposed inner side, said specular coating reflecting a portion of the light emitted by lamp 93 through the open end of reflector 92. Plastic lamp assembly 79, FIG. 28, comprises lamp 93, socket 94, cradle 91 and reflector 92. Lamp assemblies 79, so assembled, are positioned, FIG. 24, at each side of face plate 87, assemblies at left supported by left upright 90, FIG. 27, and assemblies on right by righthand upright 81. The longitudinal axes of said two rows of lamp assemblies 79 are positioned parallel to the side edges of the emplaced document page, one row bordering said page from top to bottom on the lefthand side, and the other row bordering said page from top to bottom on the righthand side; the longitudinal axis of each lamp assembly 79 is placed in a perpendicular relationship to the longitudinal axis of each row. Each lamp assembly in the lefthand row is pointed toward the right and tilted toward the document page, casting a shaft of illumination upon a generally rectangular portion of the inscription extending from edge to center of said inscription; each lamp assembly 79 in the righthand row is pointed toward the left and tilted toward the document page, casting a shaft of illumination upon a generally rectangular portion of the inscription extending from edge to center of said inscription. The horizontal edges of the two illuminated portions of said inscription are collinear. The two shafts of illumination crisscross. The shaft of light cast by the lamp assembly 79, FIGS. 24 and 28, at the left side of face plate 87 illuminates the righthand half of the inscribed area illuminated by the pair of lamp assemblies. The shaft of light cast by the lamp assembly 79 at the right side illuminates the lefthand half of said inscribed area. Each lamp assembly at the left side of the document page is paired with a counterpart lamp assembly at the right side. The topmost assembly 79 in the lefthand row of assemblies is connected in series with the topmost lamp assembly in the righthand row. Each succeeding pair of lamp assemblies below the topmost pair also are connected, respectively, in series. Each pair of lamp assemblies is activated, brightened, dimmed and extinguished as one unit by the microprocessor. When pulse trains from display driver 112, FIG. 29, are made available via G1 . . . G14 to the bases of transistors 122, FIG. 32, said individual transistors 122 activate individual pairs of lamps 93, FIGS. 26, 28 and 32. Control of the brightness of pairs of lamps 93, is exercised by increasing, stabilizing and decreasing the length of the pulse train applied to each base G1, G2 . . . G13, G14 of the individual transistors 122. Control of the time span of the page cycle represented by sequential activation of all 14 pairs of lamps 93 is exercised by the timing of the application of the pulse trains to specific bases G1 . . . G14. The zone of light produced by a pair of assemblies 79 is a slender, horizontally placed, generally rectangular highlighting area bearing a lateral dimension equal to the width of the inscription being processed, and bearing such height that the horizontal edges of the zone of light generally coincide with the horizontal edges of zones of light cast by pairs of lamp assemblies 79 adjacent to said pair. Down the center of said inscription, light diffusion blends the shaft of light from one side of the document page with the shaft of light from the opposite side so that the inscription is illuminated sequentially by even fields of light. The angle at which each lamp assembly 79 is tilted precludes the appearance of contours of granularity and slight wrinkling of the sheet of paper in the image presented to the operator.

Signals from the microprocessor direct the sequentially highlighting performance of the place keeping functions of the copy holder, said functions providing a frame of reference to the operator in holding to the point of attention in processing the inscription on the document page. The operator may change basic functions at will, using basic microprocessor Descend, Stride, Step, First Keyboard and Second Keyboard functions, said five functions immediately initiating, upon completion of respective page cycles, new respective page cycles at the top of the inscription on the document page in place on the copy holder; the operator also may use basic microprocessor Sectional function for special applications heretofore noted, said Sectional function page cycle being initiated at the bottom of the inscription. The five functions mentioned initiate a new page cycle upon an exchange of document pages mounted on the copy holder; the Sectional function retains the selected field of light from one exchange of document pages to the next until the basic function is changed by the operator by the use of switches 123, 124, 125, 126 and 127, FIG. 33, or by release and relocking of on-switch 95. The Third Embodiment performs, with front lighting, the functions performed by the back lighting First and Second Embodiments.

In this microprocessor group of three embodiments, as in all of the embodiments at all times, illumination continuously stands subject to modification of intensity directed by the operator, accommodating the level of tolerance of light experienced by said operator and facilitating perception by the operator personally of optimum display contrast between the characters themselves comprising the inscription and the background upon which they appear. In these First, Second and Third Embodiments said modification of intensity is executed by the operator in using the Brighten/Dim switch 128, FIG. 33. Said illumination is addressed to the inscription itself upon the page in all embodiments, First Embodiment through Seventh Embodiment. In the First, Second, Fourth and Sixth Embodiments, approximately one-half of the blank, unneeded margining space of the inscribed document page mounted on the copy holder is masked from illumination; top framing 26, FIG. 18, masks a major portion of the top margin of the page; left framing 61 and right framing 62 mask major portions of the side margins; and console cover 6, FIGS. 2 and 20, masks a major portion of the bottom margin. In the other embodiments, the Third, Fifth and Seventh Embodiments, approximately one-half of the margining space of the page also is masked from illumination; top framing 261 masks a major portion of the top margin; left shield 76 and right shield 77 mask major portions of the side margins; and console cover 13, FIG. 23, masks a major portion of the bottom margin. Thus, in all of the embodiments, a major portion of the margining area of the page is masked from illumination, minimizing luminous flux which enters the eye from empty space on the page, diminishing glare within sight of the operator and reducing dilation and contraction of the pupil by muscular action of the iris. The word inscription throughout this presentation is defined as the unmasked operative portion of the document page. It should be pointed out that any part of the inscription masked from back lighting in the four back lighting embodiments of the copy holder and any part masked from front lighting in the three front lighting embodiments remain visible since the document page remains in full view of the operator in the ambient lighting of the work station. The inscription referred to here comprises the general area of the document page bearing and bordering the text inscribed upon the positioned document page.

In the microprocessor First, Second and Third Embodiments the performance of the Descend and Stride place keeping functions are executed at infinitesimally variable rates extending from those of several seconds to those of several hours per page. Upon the closing of the circuitry for a work session, the rate established by the microprocessor is that represented by a page cycle of approximately 50 single spaced lines sequentially illuminated in approximately 10 minutes. In the First and Second Keyboard functions, the rate of descent of the field of light is established by the rate at which input is entered into the keyboard machine. In all four functions, the Descend, Stride, First Keyboard and Second Keyboard place keeping functions, the rate of descent is constantly and directly under the control of the operator, as the longitudinal intensity center of the field of light descends, said control being exercised by use of the rate change function; said rate change function is activated by the use of Fast/Slow rocker switch 129 Brighten/Dim rocker switch 128, FIG. 33.

These four basic functions and the basic Step function proceed with the movement of the longitudinal intensity center of the field of light subject to instant advance by the momentary performance of the microprocessor Advance function, said Advance function being activated by use of Advance switch 75, FIG. 33. In the Advance function the longitudinal intensity center of the field of light cast upon the inscription moves downward by one segment cycle. In the Descend, First Keyboard and Second Keyboard functions, this descent amounts to one made by the height of the fully lighted center zone containing said longitudinal intensity center. In the Stride and Step functions the descent amounts to one made by the height of a fully lighted zone, said fully lighted zone being one of the two fully lighted zones in place upon the inscription during execution of the Stride and Step functions.

The segment cycles of the Descend, Stride, Step, First Keyboard, and Second Keyboard place keeping functions are subject to instant arrest by the performance of the microprocessor Pause function wherein movement of the field of light is halted by use of the Pause lock switch 132, FIG. 33, until the operator, in holding to the operative passage in the inscription on the document page, releases said Pause function by releasing said Pause lock switch.

The progression of Descend, First Keyboard and Second Keyboard place keeping functions in the First, Second and Third Embodiments stands subject to performance of the microprocessor Large Field function wherein the height of the field of light is increased by the height of the fully lighted center zone of said field of light, a second fully lighted zone, identical to the first, appearing below and adjacent to said center zone. The Large Field function is entered when operator activates Large Field lock switch 130, FIG. 33. The progression of Stride and Step place keeping functions in these three embodiments stands subject also to performance of the Large Field function; the field of light in view in said two functions is doubled in its vertical dimension. The two zones of light employed in the performance of Stride and Step functions are joined by two zones of light identical to the first two zones and positioned immediately below them. In both functions the segment cycle comprises a progression of the horizontal center of light intensity downward by one-half of this four-zone field of light. Activation of the Advance function with the momentary contact Advance switch 75 extinguishes the top two zones of light and produces the appearance of two new zones of light, extending the operative field of light to the four-zone size.

The progression downward of the field of light in the Descend, Stride, First Keyboard and Second Keyboard functions in these first three embodiments is subject to activation of microprocessor Double Speed function wherein the rate of the performance of a segment cycle is doubled. The progression of the Descend, Stride, First Keyboard and Second Keyboard functions stands subject to implementation of the rate change by use of Slow/Fast switch 129, FIG. 33, and to implementation of the Advance, Pause and Large Field functions, to release of the Double Speed function, and to a change from one function to another basic microprocessor function.

In the performance of Descend, Stride, Step, First Keyboard and Second Keyboard place keeping functions by the copy holder in the First, Second and Third Embodiments, new respective page cycles are instituted immediately upon completion of the respective page cycles; said new page cycles are instituted also following removal of the document page and the attendant extinguishing of the field of light, with insertion of a new document page. In performance of the Sectional function, the field of light is retained in configuration and position upon insertion of a new document page. In the event that, with a page mounted in position on the copy holder, a period of approximately 30 minutes should elapse without the use of any switch on console 115, FIG. 33, and without exchange of document pages on the copy holder, the illumination is extinguished; the microprocessor continues to monitor the circuitry, and upon an exchange of document pages said microprocessor will resume the function in progress when illumination was extinguished; with the document page remaining in place and a basic function switch operated, the microprocessor initiates the performance of the corresponding function. Said basic function switches are Descend switch 123, Stride switch 124, Step switch 125, Sectional switch 126 and Keyboard Switch 127, FIG. 33.

In the microprocessor First, Second and Third Embodiments, as in all the embodiments of the invention, thermal switch 19, FIG. 4, activates instrument fan 18, FIGS. 4 and 7, in the event that temperature of the air in the upper interior of the copy holder should approach an undesired level.

Taking an overview of the functioning itself of the copy holder, isolated from mention of structure, material and acts, in the first three embodiments, will produce a fuller disclosure than has been made. Selection of only a few features will suffice. The copy holder of the First, Second and Third Embodiments provides fields of light which comprise a display of the perceived effect of moving fields of light and temporarily displayed stationary fields of light as the guide in keeping the place in a text being processed by an operator using a keyboard machine and studying, translating, editing, proofreading and reviewing said text. The copy holder contains means for securing the top and supporting the bottom of a stationary inscribed document page remaining in full view of said operator. Light emission elements, and a data processing system containing nonvolatile programmed memory, hereinafter said system being termed microprocessor, with attendant circuitry, electronic components and control switches constitute the operative systems of the copy holder.

The light emission elements of all embodiments perform, with the respective power and control systems, two services at once; through a plurality of basic place keeping functions, said elements and systems deliver fields of light upon the inscription, said fields of light providing the operator of said copy holder with a frame of reference for keeping the place in processing a document page word by word and figure by figure, said frame of reference comprising the boundaries of said fields of light cast sequentially upon succeeding portions of the inscription on said document page as highlighting; in addition to providing this place keeping highlighting, all embodiments deliver illumination as such to said inscription from close up, said illumination being infinitesimally variable. Said highlighting and illumination is accomplished, as the place of attention in the inscription advances from moment to moment, through the performance of a plurality of place keeping functions directed by the microprocessor and executed by the light emission elements. Said light emission elements in the First Embodiment are lamps 36, FIGS. 12 and 30; in the Second Embodiment LEDs 72, FIGS. 21, 22 and 31; and in the Third Embodiment lamps 93, FIGS. 26 and 32. Said place keeping functions are performed at rates extending from those of several seconds to those of several hours per page, and are applied to move emplacements of fields of light in conventional patternings selected for the absence of distraction which they exhibit to the operator as said operator engages in the close demanding work of processing one document page after another, figure by figure and word by word.

The Descend function employs a slender, rectangular horizontally disposed field of light cast upon a portion of the inscription, said field of light comprising a top zone slowly dimming from the full value of the established intensity, a center zone displaying full intensity, and a bottom zone slowly brightening, each zone being rectangular, horizontally disposed and of a width identical to that of said field of light, the moving field of light producing the perceived effect over all, as the longitudinal intensity center of the field of light descends, of a light beam shining upon a slender horizontal portion of the inscription, and steadily moving down said inscription, said operator adjusting the copy holder to the rate of descent needed for producing the work at hand.

The Stride function employs a slender, rectangular, horizontally disposed field of light cast upon a portion of the inscription in work, said field of light being emitted by lamps 36, FIGS. 12 and 30 in First Embodiment, LEDs 72, FIGS. 21, 22 and 31 in Second Embodiment, and lamps 93, FIGS. 26 and 32 in Third Embodiment. The field of light comprises two slender, rectangular fully lighted zones, the bottom edge of the top zone coinciding with the top edge of the bottom zone. Said field of light remains in position until expiration of a term established by the page cycle rate in effect, upon said expiration the top zone of the field of light quickly dimming and continuing to dim to the point of extinction as, simultaneously, below and adjoining the bottom zone of said field of light, a slender, rectangular new zone, top edge of said new zone coinciding with bottom edge of bottom zone, quickly brightens and continues to brighten to full value, with the result that a new field of light is formed and a new segment cycle entered. The segment cycle progresses toward completion as the field of light remains motionless on a portion of the document page, upon completion of said cycle the top zone of the field of light quickly dimming and continuing to dim to the point of extinction as, simultaneously, below and adjoining the bottom zone of said field of light, a slender, rectangular new zone, top edge of said new zone coinciding with bottom edge of bottom zone, quickly brightens and continues to brighten to the point of full value of the established intensity. This field of light remains motionless on a passage of the document page, said segment cycle continuing to completion. Upon completion said segment cycle is succeeded by other segment cycles, the microprocessor Stride function continuing, as the operator holds the textual place, to move down the length of the inscription at regular intervals in salient changes of position, making advances in leapfrog fashion, the top zone of each new field of light overlapping the bottom zone of the preceding field of light. The progression of said fields of light is maintained toward completion of the page cycle, subject at any moment to rapidly repeated uses of the microprocessor Advance function, said uses of the Advance function moving the overlapping fields of light through said page cycle and into the next page cycle, highlighting any area within the page cycle, said progression of said fields of light being subject to the performance of microprocessor Pause, Rate Change and Double Speed function, said progression subject as well to the performance of Large Field function. The Large Field function displays a field of light of a height double the height of the regular sized field of light, the movement of the field of light of the Large Field function proceeding at a page cycle rate identical to that of said regular sized field of light, with one-half as many changes of position commanded in performance of the Large Field page cycle as are commanded in performance of the regular sized page cycle, so that, in changes of the position of the field of light in the Large Field function and in such changes effected by momentary use of the Advance function, the top half of the field of light is dimmed out and a new Large Field zone identical in size and shape to said dimmed out zone appears and is brightened to full established intensity simultaneously. Performance of the Large Field function coupled with performance of the Double Speed function is indicated for use on those occasions wherein the inscription is given in double spaced keyboarding. Coupling performances of the Large Field and Double Speed functions is indicated also for such use during the performance of the microprocessor Descend, First Keyboard and Second Keyboard functions.

The Step place keeping function is performed by means of momentary uses by the operator of the microprocessor Advance function, with momentary contact Step switch, FIG. 33, first activated. Use of the Advance function signals changes of segment cycles at each closing of the Advance switch 75. Basic microprocessor Step function duplicates the activation, dimming, brightening and deactivation of zones within the field of light obtained in the performance of the basic microprocessor Stride function just described, wherein changes of segment cycles are timed by the microprocessor. In the microprocessor Step function the operator times said changes of segment cycles. With each change the field of light moves downward in salient stages subject to the performance of the Large Field function as it is performed in the basic microprocessor Stride function.

The above overview completes the description of microprocessor First, Second and Third Embodiments. It is noted that the color imparted to the back lighting of the inscribed document pages, in the Second Embodiment, by uncolored face plate 260, FIG. 21, is of a yellow hue which differs slightly from the yellow hue imparted to the document pages by colored face plate 60, FIG. 18, which is used in the other back lighting embodiments, the First, Fourth and Sixth Embodiments. In the Second Embodiment face plate 260 conveys the yellow hue of LEDs 72, FIGS. 21 and 22, to the document pages.

In the First, Second, Fourth and Sixth Embodiments, use is made of the cardinal translucence index of the paper stocks in common office use by emplacement of the light emission elements for back lighting of inscriptions upon positioned document pages, said emplacement being located behind the positioned pages. In the Third, Fifth and Seventh Embodiments, emplacement of the light emission elements for front lighting of inscriptions on positioned document pages is made in front of the plane of the document pages. The light emission elements of the Third Embodiment, and the procedures for assembling and installing them, are used in the Fifth and Seventh Embodiments.

In all embodiments, First through Seventh Embodiments, the sequentially lighting copy holder possesses several identical physical characteristics. All embodiments are characterized by the absence of a need for collapsing construction since the copy holder of each embodiment is a compact instrument occupying desk space approximately equal to the area of the document page said copy holder illuminates. All embodiments are bottom heavy, and maintain stability of footing with mats which serve also as a device for adjusting the inclination of the copy holder from the horizontal plane and, with it, the document page upon it, said document page being viewed by the operator in processing documents page by page. Without a need for fastening procedure, said document page is supported and secured at top and bottom; said document page remains free to be shifted laterally by the operator while secured upon the copy holder. Said copy holder, in all embodiments, provides the operator with a frame of reference for holding to the place in processing the document page, said frame of reference comprising the horizontal and vertical boundaries of fields of light cast sequentially upon succeeding portions of the inscription on the page. Said copy holder delivers illumination as such, in addition to providing said frame of reference, said illumination being emitted close up to said document page, the intensity of said illumination being infinitesimally variable.

The Fourth Embodiment, and electronic manual embodiment, FIGS. 34, 35 and 37, employs liquid crystals to control the display.

Physical structurings of the Fourth Embodiment are those of the First Embodiment as depicted in FIGS. 2, 3, 4, 5, 6, 7, 8, 11, 18 and 19. These structurings have been detailed.

The back lighting Fourth Embodiment, and the manual, front lighting Fifth Embodiment as well, provide fields of light which comprise a display of the perceived effect of moving fields of light and temporarily displayed stationary fields of light as the guide in keeping the place in a text being processed by an operator using a keyboard machine and studying, translating, editing, proofreading and reviewing said text. Said embodiments contain means of supporting and securing a stationary inscribed document page remaining in full view of said operator, light emission elements, and a manually operated electro-mechanical control of said light emission elements. Said electromechanical control comprises electronic circuitry, an infinitesimally variable modifiction of light intensity, and a sectional display selection means, said copy holders in Fourth and Fifth Embodiments highlighting portions of the inscriptions in sequence. Each inscription comprises the general area bearing and bordering a text inscribed upon the positioned document page, the illumination continuously being subject to modification of infinitesimally variable intensity directed by the operator, accommodating the level of tolerance of light of said operator and facilitating optimum perception by said operator personally of the display contrast between the characters of said inscription and the background upon which the characters appear. Said illumination is addressed to the inscription itself upon the page. A major portion of the margining area at top, sides and bottom of said page is masked from illumination, minimizing luminous flux which enters the eye from empty space on the page, diminishing glare and reducing dilation and contraction of the pupil by muscular action of the iris. The highlighting is accomplished, as the place of attention in the inscription advances from moment to moment, through the performance of a plurality of place keeping functions directed by the electronic circuitry, the sectional display selection means and signals given by the operator, and is executed by the light emission elements. The place keeping functions are performed at rates extending from those of several seconds to those of an unlimited number of hours per page. Said functions are applied to move emplacements of the fields of light in conventional patternings selected for the absence of distraction which they exhibit to the operator as said operator engages in the close demanding work of processing one document page after another, figure by figure and word by word.

In the Fourth and Fifth Embodiments, the basic manual Step function is initiated with the appearance of a slender, rectangular, horizontally disposed field of light cast by the light emission element upon the top area of the inscription. Said field of light comprises two slender, rectangular fully lighted zones, the bottom edge of the top zone coinciding with the top edge of the bottom zone. Upon momentary activation of advance switch 75, FIGS. 9 and 37, the top zone is extinguished and, simultaneously, a slender, rectangular new zone appears, top edge of said new zone coinciding with bottom edge of bottom zone of the old field of light, completing a segment cycle and producing a new field of light lower on said inscription than the position of the first field of light by one-half its height. Said new field remains in place, steadily high-lighting the newly lighted portion of the inscription until subsequent uses of Advance switch 75, FIG. 37, completes subsequent segment cycles. The passages of the inscription are highlighted in sequence by the fields of light as the operator holds the textual place. The top zone of each field of light overlaps the bottom zone of the preceding field of light as the manual Step function continues with salient changes of position of the fields of light advancing in leapfrog fashion. This progression is maintained subject to rapidly repeated uses of Advance switch 75, which move the field of light through one page cycle and into the next, reaching any inscribed area. Said manual Step function upon ending a page cycle immediately initiates a new page cycle at the top of the inscription. Said new page cycles are initiated also upon removal of the document page, with attendant extinguishing of highlighting and an insertion of another document page in the copy holder.

In the basic manual Sectional place keeping function, small and large undivided fields of light are cast sequentially upon portions of the inscriptions for processing, said pages being short memoranda, office forms, invoices and orders being documented, source pages bearing needed information on only portions of the vertical extent of said pages, pages of formula computation, mailing lists, pages in such form that highlighting less than the entirety of each page is indicated, and forms being processed in batches. For such processing, said manual Sectional function is selected by use of Sectional switch 152, FIGS. 34 and 37; the selection is acknowledged by the appearance of rectangular, horizontally positioned, contiguous zones of light shining steadily at the established intensity upon an area of the inscription. Application of said Sectional function is made by use of both Sectional switch 152 and the electronic circuitry, FIG. 34. A subsequent use of said switch and circuitry produces the appearance of a second field of light adjacent to the initial field, a horizontal edge of said second field of light coinciding with a horizontal edge of said initial field. The appearance of each new field of light completes a segment cycle. Other uses of Sectional switch 152 change the configuration of the assembly of fields of light, and the sequential alteration of said configuration mounts an undivided assembly of fields upon the inscription. The topmost area of said inscription is excluded from receiving highlighting; the inscription bears partial lighting only, for tenure of Sectional function. The assembly of fields of light selected by the operator remains stationary through processing of the page. The highlighting is extinguished upon removal of said page. The size and positioning of the selected assembly of fields of light are restored upon replacement of said document page by another page, a feature used in processing document pages by the batch. Of basic place keeping functions, the Fourth and Fifth Embodiments perform the Step and Sectional funtions only.

In the Fourth Embodiment a battery of LCDs (liquid crystal devices) admits fields of light to the document page, with intensity of the light, and the timing of the activation and deactivation of the light source controlled from console 257, FIG. 37. The use of 12 LCDs, one of the appropriate numbers of LCDs which may be used, is preferred. LCD1 154, LCD2 155 . . . LCD12 156, FIG. 35, are mounted horizontally to the front surface of glass substrate 160, said substrate being positioned close to the back surface of face plate 60. Minute gaps isolate each LCD from the others at the horizontal edges. The ends of each LCD are slightly overlapped by left framing 61 and right framing 62; top edge of LCD1 is overlapped by top framing 26, and bottom edge of LCD12 is positioned below top console cover 6. Each LCD is a thin rectangular strip of nematic liquid crystal. The produce may be procured from Integrated Display Systems, Inc., Montgomeryville, Pennsylvania and from several other suppliers.

Also installed inside the copy holder, standard incandescent bulb 51 assembly and, behind it, specular reflector 223 of polished aluminum sheet are affixed to base 45, FIG. 4, along the longitudinal axis of said base. Semicylindrical nonfocusing reflector 223 is installed without auxiliary reflectors.

When power is applied at on-switch 95, FIG. 34, and a document page before paper sensor 66 has closed the circuit, copy holder is ready to perform the Step function. The bottom 10 of the 12 LCDs 154 . . . 156 are energized and therefore have been made opaque. Deenergized LCD1 154 and LCD2 155, remaining clear, pass light emanating forward from bulb 151 and reflector 223 through substrate 160 and face plate 60, illuminating the upper two-twelfths of the inscription on the page. At this initial stage, terminals G1 and G2 have been energized through diodes 119, which isolate NOR gates 157 and 158 from other NOR gates.

When a positive voltage is applied to junction 133, and a lower positive voltage from the voltage divider formed by resistors 225 and 226 is applied to junction 134, switching transistor 137 is triggered into conduction. Each counter stage comprises a switch with an n-p-n triggering transistor 141 and a p-n-p output transistor 142. When a stage begins to conduct current, the voltage at junction 134 is reduced to a value of less than that required to trigger the other counter states, and those stages are held inoperative. The first stage is maintained until a trigger pulse is applied by manual operation of either of the two momentary contact switches 75. When said trigger pulse is applied, a negative voltage signal pulse derived from terminal 135 of regulated power supply 117 is applied to the base of switching transistor 137, driving it to cutoff. Counter stages are held inoperable for the duration of the trigger pulse. When the pulse is removed, switching transistor 137 again will conduct through one of the counter stages. No current will flow through resistor 138 or capacitor 139, for capacitors 139 is charged to the voltage appearing at junction 133. In addition, the charge on capacitor 149 will reverse bias diode 148, impeding the flow of current through the first counter stage. This same diode 148 now will series-aid the power supply and will cause the second stage to be triggered into conduction before current can flow through any other stage. With the momentary closing of Advance switch 75, to advance the fields of illumination down the document page, cutting off the first stage and turning on the second stage, input terminal G1 ends the signal to NOR terminal G1, and input terminal G2 is joined by G3 in supplying positive voltage signals to NOR gate terminal G2 and the third NOR gate terminal. NOR gate terminal G2 continues to receive a positive voltage signal, and the third NOR gate terminal begins to receive such a signal; together, LCD2 155 and the third LCD pass light through the second and third twelfths of the inscription.

When the next counter shift is initiated by closing Advance switch 75, the charge on capacitor 150 will assure that the third counter stage is turned on. Similarly, all the stages will be traversed. Eleventh stage is followed immediately by first stage.

The liquid crystal display, controlled by the counter, requires a square wave input of approximately 2000 hertz, with positive and negative voltage peaks relative to system ground provided. This square wave is supplied by the astable multivibrator consisting of inverting amplifiers 224 and 161, timing resistor 162, timing capacitor 163, and power inputs 135 and 201, which receive power from regulated power supply 117. Upon removal of the square wave signal from LCD1 154 . . . LCD12 156, light will pass through the liquid crystal barrier. Through NOR gates 157 and 158 . . . 159 the ring counter circuit may be coupled to the square wave source to designate the particular devices, LCD1 154 . . . LCD12 156, which remain opaque. The square wave is applied to lower input terminals 227 of each of the twelve NOR gates 157 . . . 159; when a positive voltage signal is applied to any input terminal G1 . . . G12, no output signal will appear at the corresponding outputs of NOR gates 157 . . . 159.

To replace the Step function with the Sectional place keeping function, the operator presses Sectional switch 152, FIG. 37, into place, enabling rotary switch 152' and disabling the ring counter. The operator may gate groups of liquid crystal devices LCD155 . . . LCD12 156, connecting the positive output of power supply 117 to groups of NOR gates 157 . . . 159 and highlighting selected portions of the pages processed, said pages being short memoranda, office forms, invoices and orders being documented, source pages bearing needed information only on portions of the vertical extent of said pages, pages of formula computation, mailing lists, pages in such form that highlighting less than the entirety of said pages is indicated, and forms being processed in batches. A manual clockwise rotation of Sectional switch 152 permits the operator to choose from these illuminated fields for the document at hand, said fields being sequentially illuminated: First field: G2 G3 G4. Second field: First field with G5 G6 G7 G8. Third field: First and Second fields with G9 G10 G11 G12. Fourth field: G5 G6 G7 G8 G9 G10 G11 G12. Fifth field: G9 G10 G11 G12. Access to these five fields of light may be obtained by turning Sectional switch 152 counterclockwise and producing the fields in reverse order. For the exclusively partial lighting of the Sectional function, G1, representing the topmost LCD1 153, cannot be used.

Operator exercises full control manually through either function provided in this Fourth Embodiment. In the Step function one field of light of a height of one-sixth of the page is succeeded by the next field of light at the touch of Advance switch 75, the second field of light overlapping the first by half the height of the first field of light, all fields of light being identical in size and shape. As the second field of light appears, the top zone of the first field, comprising the top half of said first field, disappears, leaving a portion of the inscription bearing illumination by a field of light lower on said inscription by one-half the height of said field of light. The second field of light is succeeded in the same way by a third field still lower on the inscription by one-half the height of said field of light. Other such segment cycles ensue in response to uses of Advance switch 75. At any instant when the moving place in the text of the inscription being processed has descended beyond the midpoint of the field of light, until said place in the text nears the end of the highlighted passage, the operator may flick Advance switch 75 for another drop of the lighted field. In the event that returning to a place in the inscription, said place being located above the field of light in effect, should be indicated, quick repeated touches of the Advance switch will move the highlighted area one-twelfth page at a time through the page cycle and, from the top of the inscription, into the next page cycle to reach said place in the inscription.

Potentiometer 191, FIGS. 34 and 36, delivers any degree of brightness from illumination too dim to be of significant use to illumination brighter than that ordinarily needed. A plurality of light emission elements of varied designated wattages would impart a choice of light intensities: the even illumination, which is infinitestimally variable, provided by potentiometer control is preferred. Potentiometer 191 and the other controls, on-switch 95, Advance switch 75 and Sectional switch 152, are operated manually from console 257, FIG. 37. Potentiometer 191, FIGS. 36 and 37, serves Fifth Embodiment also.

The electronic manual Fifth Embodiment, FIGS. 23, 24, 25, 26, 27, 28, 36 and 37, provides front lighting of the inscription on the document page mounted on the copy holder. Physical structurings of the Fifth Embodiment are those of the Third Embodiment, which have been detailed. The Fifth Embodiment performs the same three functions, the basic manual Step, basic manual Sectional, and Advance functions, as those performed by the Fourth Embodiment of the copy holder. The display system of this Fifth Embodiment, employing lamps 93, FIGS. 26 and 28, is shown at the bottom of FIG. 36.

The display system employs 14 pairs of said lamps 93, in series. Upon the closing of the circuitry by use of on-switch 95 and the placing of a document page before paper sensor 66, FIG. 36, current is applied to upper terminals G1 . . . G14 by the method already described in the detailing of the Fourth Embodiment. Now the first stage of the ring counter is conducting through diodes 121 G1 . . . G2, and current is supplied to the first two pairs of instrument lamps 93, with two lamps at the left side of the document page and the other two lamps at the right side, the two shafts of illumination from lamps on one side of the inscription crisscrossing the two shafts of illumination from lamps on the opposite side of the inscription, through terminals G1 . . . G2. The lamps of this embodiment are activated at the intensity given by use of potentiometer 191, FIG. 37.

A closing of Advance switch 75 shifts the flow of current to terminals G2 and G3, FIG. 36, changing the field of light upon the document page from one emitted by the two topmost pairs of lamps to one emitted by the second and third pairs of lamps. This sequential lighting of the inscription is maintained through the lighting of the bottommost pairs of lamps through terminals G13 and G14. The next flick of Advance switch 75 shifts the current back to terminals G1 and G2 to energize the first two pairs of lamps, and a new page cycle is begun. Upon removal of the page and the insertion of another at any point within the old page cycle or at the end of said page cycle, terminals G1 and G2 are activated and the new page cycle may begin. The basic manual Step place keeping function is performed in this Fifth Embodiment with terminals G1 . . . G14 as it is performed in the Fourth Embodiment with terminals G1 . . . G12.

To replace the Step function with the Sectional function, the operator locks down Sectional switch 152, FIG. 37, directing current from regulated power supply 117 to one or more of four groups of rotary switch terminals G1 . . . G14, FIG. 36, as switch 152 is rotated clockwise, producing seven sequentially lighted fields from which operator may choose for processing the classes of document pages mentioned in the detailing of the Fourth Embodiment. These fields of light are produced through the following terminals: First field: G2 G3 G4. Second field: G2 . . . G7. Third field: G2 . . . G10. Fourth field: G2 . . . G14. Fifth field: G5 . . . G14. Sixth field: G8 . . . G14. Seventh field: G11 . . . G14. Upon entry into the Sectional function of either the Fourth Embodiment or this Fifth Embodiment, the field of light activated by that entry is the field which was activated by the most recent use of the Sectional function, without regard for whether the copy holder has been turned off since that occasion. The seven fields of the Fifth Embodiment Sectional function may be produced in reverse sequence by the rotation of switch 152 counterclockwise. In the partial lighting which characterizes the Sectional function in all embodiments, a portion of the inscription remains unilluminated at all times; in the Fifth Embodiment Sectional function terminal G1 stays inactivated.

The electromechanical Sixth Embodiment of the sequentially highlighting copy holder, FIGS. 44 and 45, offers back highlighting of the inscription on the mounted document page. Physical structurings are those of the First Embodiment, which have been detailed. The Sixth Embodiment performs the basic motorized Stride place keeping function, which is a function distinguished from the basic microprocessor Stride function of the first three embodiments; the basic Sectional function; and the Pause function. Light emission element of this Sixth Embodiment comprises the battery of incandescent lamps 36 employed in the First Embodiment and seen in FIGS. 10 and 12.

With on-switch 95 closed, FIGS. 44 and 45, and paper sensor 66 completing activation of the power, control and display circuitry, ac power is applied to the primary winding of step-down transformer 174 and is made available by means of lines 205 to thermal switch 19 and instrument fan 18. With Sectional switch 153 in the up or disengaged position, the copy holder is ready to perform the motorized Stride function. Said ac power also is applied to SCRs (silicon controlled rectifiers) 200. SCRs 200 control the sequence in which 14 incandescent lamps 36, FIGS. 10 and 12, are activated by means of signals received at the individual gates G1, G2 . . . G13, G14. When switch 152, FIGS. 44 and 45, is in position to supply power to line 178 and line 188, FIG. 44, ac power from the secondary side of step-down transformer 174 is supplied to the input of full wave rectifier bridge 175, which consists of diodes 176; step-down transformer is used to decrease the voltage level to a value consistent with the ratings of the other circuit components. Capacitor 186 charges through resistor 182 and diode 181; a voltage will appear across capacitor 186 when SCR 203 is not conducting. As capacitor 184 is charged through resistor 182, potentiometer 173 and resistors 180 and 179, the voltage across capacitor 184 will approach the triggering voltage of the transistor switch formed by p-n-p transistor 204, n-p-n transistor 206 and biasing resistors 212 and 183. When the voltage across capacitor 184 reaches the trigger level, transistors 204 and 206 will conduct and supply gate current to SCR 203 through line 227. The gate current will cause SCR 203 to conduct, and the voltage across capacitor 186 will drop to zero.

When there is a voltage across capacitor 186, and Pause switch 172 has not arrested the progress of the Stride function but instead is in the on, or up, position, dc motor gearhead 207 will operate. Speed of motor gearhead may be changed at the console by increasing and decreasing the resistance of potentiometer 173, FIG. 45. As resistance is increased, capacitor 184 will charge more slowly and SCR 203 will remain off for a longer portion of each half cycle of pulsating dc. This will allow voltage across capacitor 186 to reach a higher level during each half cycle, thereby increasing the speed of motor gearhead 207. Conversely, as the resistance of potentiometer 173 is decreased, capacitor 186 will reach a lower level of voltage during each half cycle, and the speed of motor gearhead will decrease. The voltage to motor gearhead 207 is filtered by capacitor 186 and said voltage reaches a dc level determined by the duration of the on and off periods of SCR 203. Diode 181 isolates SCR 203 from capacitor 186, and resistors 228 and 182 provide a discharge path for capacitor 184 after SCR 203 begins to conduct.

A small signal from the voltage divider formed by resistors 177 and 185 is applied to line 188 and from there to gold brush 164, FIGS. 39 and 40, said gold brush being affixed to gold brush holder 165. As FIG. 39 shows, the voltage divider signal also is applied to gold slip ring 163, mounted on insulating sleeve 162, and to berryllium copper wiper 166, said insulating sleeve and wiper being affixed to output shaft 161 of motor gearhead 207.

The decision to use a gearhead was made in order to obtain the low speeds required for this application, to provide a motor torque that prevents the wiper 166 from hanging up or seizing, and to provide smooth rotation.

Vibration of motor gearhead 207, FIG. 38, is minimized by yoke 219; gold brush holder 165 is supported by insulating pedestal 217; contact assembly 213, of printed circuit material, with individual copper contacts 214 affixed, is secured to insulating disk pedestal 215 with bolt 216; and base plate 218 serves as foundation for the motor gearhead 207 and contact assembly, FIGS. 38, 39 and 40.

In performance of the basic motorized Stride function, as motor gearhead 207 revolves, energized through insulated leads 159, FIGS. 38, 39 and 40, wiper 166 applies in sequence the small signal from the voltage divider formed by resistors 177 and 185 to contacts 214 of contact disk 229, FIG. 39. As each contact 214 is energized, it applies voltage to terminals G1–G2, G2–G3 . . . G13–G14, one pair of terminals after the other, gating SCRs 200 and lighting the corresponding lamps 36, FIGS. 10 and 12. This action on contact disk 213 is illustrated in FIG. 41. From a position between page cycles, wiper 166″ on the circumvolution touches the first contact 214 and activates terminals G1–G2. Wiper 166′ is touching both the first contact 214 and the second contact 214, activating G1–G2 and G2–G3 for a few seconds, a period correlated with the rate set by the operator on potentiometer 190, FIG. 45. Wiper 166 is touching only the second contact 214, activating terminals G2–G3, and a second segment cycle of the Stride function has begun.

On the document inscription mounted on the copy holder, the first and second lamps 36 are highlighting the two zones of the first field of light, which appears at the top of said inscription, as long as wiper 166″, FIG. 41, is in contact with the first contact 214. Then, with wiper 166′ touching both the first and the second contact 214 for a short period, the topmost three zones of the inscription are lighted with a field of illumination half as large again as the regular field, for the same short period. At the end of this transitional period from first to second segment cycle, the first lamp 36 is extinguished. In the transition from second segment cycle to third, the second, third and fourth lamps are activated for the short period and then the second lamp is extinguished. The Stride place keeping function proceeds as the operator processes the inscription on the document page, with succeeding fields of light comprising a top zone which was the bottom zone of the preceding field of light and a bottom zone which will become the top zone of the new field to come.

The operator of any of the seven embodiments may change functions at will. To replace the electromechanical Stride function with the electromechanical Sectional function, operator depresses rotary switch 152, 153 on console 171, FIG. 45, cutting off motor gearhead 207, FIGS. 39 and 44. The lamps 36, FIGS. 12 and 44, which are activated by switch 152, 153, FIGS. 44 and 45, are lighted; operator rotates switch 153 in either direction to bring rotary switch 153 to those terminals controlling the lamps which the operator wishes to have illumined. From the start of the page cycle, the lighted portions of the page are controlled by these groups of terminals sequentially: G2 G3 G4. G2–G7. G2–G10. G2–G14. G5–G14. G8–G14. G11–G14. The lamp 36 controlled by terminal G1 is not used in the partial lighting provided by the Sectional place keeping function.

During execution of the Stride function the operator may use the electromechanical Pause place keeping function by depressing Pause switch 172, FIGS. 44 and 45. With this act movement of the field of light is halted until the operator, in holding to the operative passage in the inscription, releases said Pause switch 172. In the Rate Control function, the operator's use of potentiometer 173 modifies the rate of travel of wiper 166, FIGS. 38, 39 and 41. The operator may select speeds at which the page cycle is completed in less than two minutes for such tasks as editing, and keyboarding extracts from the source document or, with this infinitesimally variable potentiometer, rates at which the page cycle lasts for more than an hour in such applications as translating, working with laboratory data and studying financial material. With potentiometer 190, FIGS. 44 and 45, operator exercises intensity control, modifying the brightness provided by lamps 36.

The electromechanical Seventh Embodiment of the seven embodiments of the copy holder has the physical structurings of the Third Embodiment, which have been detailed, power and control systems identical to those of the Sixth Embodiment, which have just been detailed, and the light emission element of the Third Embodiment, comprising 14 pairs of series connected instrument type incandescent lamps 93, FIGS. 26 and 28. Each lamp 93 installed on the lefthand side of the emplaced document page casts the body of a shaft of light upon righthand half of the document page, and the counterpart of said lamp, installed on the righthand side of the page, casts the body of a shaft of light upon the left half of the emplaced page, FIG. 26.

Controlled by motor gearhead and contact assembly, FIG. 38, in this Seventh Embodiment the electromechanical Stride place keeping function is performed as it is performed in the Sixth Embodiment. Under manual control, the electromechanical Pause and Sectional place keeping functions also are performed as in the Sixth Embodiment.

Display circuit of the Seventh Embodiment differs from that of the Sixth Embodiment. The Seventh Embodiment display circuit comprises lines 192, step-down transformer 208, full wave rectifier bridge 197, FIG. 46, consisting of diodes 196, 14 n-p-n transistors 210 and base-current limiting resistors 211, the 14 pairs of lamps 93, and potentiometer 199. In the circuit, dc power is available to lamps 93 through line 198 from the output of bridge 197. The ac input to the bridge is supplied by the secondary of step-down transformer 208. Transistors 210, with resistors 211, control the sequential lighting of lamps 93 by means of signals received at the individual gates G1, G2 . . . G14. Potentiometer 199 serves as the control of light intensity of the display, FIGS. 45 and 46.

The Sixth and Seventh Embodiments of the sequentially highlighting copy holder provide fields of light which comprise a display of the perceived effect of moving fields of light and temporarily displayed stationary fields of light as the guide in keeping the place in a text being processed by an operator using a keyboard machine and studying, translating, editing, proofreading and reviewing said text. The copy holder contains means of supporting and securing a stationary inscribed document page remaining in full view of said operator, a light emission element, and electromechanical control of said light emission element. The electromechanical control comprises electronic circuitry, an intensity of light modification potentiometer and a Sectional selector. Said copy holder highlights portions of said inscription in sequence, said inscription comprising the general area bearing and bordering a text inscribed upon the positioned document page. Illumination is continuously subject to infinitesimally variable modification of intensity directed by the operator, accommodating the level of tolerance of light of said operator and facilitating optimum perception by said operator personally of the display contrast between the characters of said inscription and the background upon which they appear. Said illumination is addressed to the inscription itself upon the page, a major portion of the margining area at top, sides and bottom of said page being masked from illumination, minimizing luminous flux which enters the eye from empty space on the page, diminishing glare and reducing dilation and contraction of the pupil by muscular action of the iris. Said highlighting is accomplished, as the place of attention in the inscription advances from moment to moment, through the performance of a plurality of place keeping functions directed by the electronic circuitry, the Sectional selector and signaling given by the operator, and is executed by the light emission element. Said place keeping functions are performed at rates extending from those of less than two minutes to those of more than one hour per page. The functions are applied to move emplacements of the fields of light in conventional patternings selected for the absence of distraction which they exhibit to the operator as said operator engages in the close demanding work of processing one document page after another, figure by figure and word by word.

The basic electromechanical Stride function of the copy holder is initiated by the appearance of a slender, rectangular, horizontally disposed field of light cast by the light emission element upon the top area of the inscription on the positioned document page. Said field of light comprises two slender, rectangular fully lighted zones, the bottom edge of the top zone coinciding with the top edge of the bottom zone. The field of light remains in position until expiration of a term established by the segment cycle rate, said segment cycle rate being set by said electromechanical control. Upon expiration of said term, said bottom zone of the field of light is joined by a new slender, rectangular fully lighted zone, top edge of the new zone coinciding with bottom edge of the bottom zone of the old field of light, with the result that a new field of light is formed, said new field of light comprising both zones of the initial field of light and the new zone as well, the top zone of the initial field of light being extinguished after a few seconds, a period related in duration directly to the rate established for the segment cycle. The extinction of the top zone of the initial field of light marks the entry of the Stride function into a new segment cycle. The Stride function progresses toward completion of the page cycle as subsequent segment cycles are performed, said segment cycles being directed by said electromechanical control of the electronic circuitry. The performance of said segment cycles produces the appearance of new fields of light whereby the passages of the source inscription are highlighted in sequence, the rate at which said segment cycles are completed being subject to infinitesimally variable modification initiated by the operator as said operator holds to the moving textual place of work in the inscription. Each field of light overlaps the bottom zone of the preceding field of light, the top zone of said preceding field of light being extinguished after the passage of a few seconds. The Stride function is continued with salient changes of the positions of the fields of light, said fields of light advancing in leapfrog fashion, the Stride function lowering the field of light to the bottom of the inscription. By gross heightening of the segment cycle rate by the operator, the field of light is brought rapidly to any area, including the top area, of the inscription, where the page cycle begins. The initiation of a page cycle also is produced by removal of the document page from the copy holder with attendant extinguishing of the field of light, and insertion of a document page in said copy holder. The Stride function is executed subject to application of the electromechanical Pause function.

In basic electromechanical Sectional place keeping function, small and large undivided fields of light are cast sequentially upon portions of the inscriptions on document pages for processing, said pages being short memoranda, office forms, invoices and orders being documented, source pages bearing needed information only on portions of the vertical extent of said pages, pages of formula computation, mailing lists, pages in such form that highlighting less than the entirety of each page is indicated, and forms being processed in batches. The electromechanical Sectional function being selected for the processing, the selection is acknowledged by the appearance of a rectangular, horizontally positioned zone of light shining steadily at the full established intensity upon an area of the inscription. Said Sectional function is applied by use of the electronic circuitry and the Sectional selector. A succeeding use of said circuitry and Sectional selector produces the appearance of another zone of light, the initial zone being joined by a second rectangular zone of light, the bottom edge of said second zone coinciding with the top edge of the initial zone of light, completing a segment cycle. Other uses of the Sectional selector change the configuration of said undivided field of light in highlighting the operative portions of the inscription, a sequential addition of said zones of light mounting said field of light upon a plurality of areas of the inscription. The topmost area of said inscription is excluded throughout performance of the electromechanical Sectional function from receiving highlighting, the full area of the inscription thus remaining partially lighted. The field of light selected by the operator remains stationary through the processing of the document page, configuration of said field of light being subject continuously to change by use of said Sectional selector. Highlighting is extinguished upon removal of said document page from the copy holder, and the size and positioning of the selected field of light is restored upon replacement of said document page by another page, a feature used in processing document pages by the batch.

In these final two embodiments of the copy holder, the Sixth and Seventh Embodiments, as in all the other five embodiments, thermal switch 19, FIG. 4, activates instrument fan 18 in the event that temperature should approach an undesired level within said copy holder.

All embodiments provide access to the light emission elements for the purpose of changing said light emission elements. In the front lighting Third, Fifth and Seventh Embodiments, lamps 93, FIGS. 26 and 28, are available upon removal of snap fitted reflectors 92. In back lighting embodiments, lamps 36, FIGS. 10 and 12, of the First and Sixth Embodiments are available upon removal of top framing 26, FIGS. 6 and 18, and face plate 60, FIGS. 3, 18 and 20. In the Second Embodiment, LEDs 72 are available upon removal of top framing 26 and face plate 260, FIGS. 21 and 22. In the Fourth Embodiment, bulb 151, FIG. 35, is available upon removal of top framing 26 and substrate 160.

Other components within the housing of the copy holder are available upon removal of hood 5, FIGS. 2 and 4, which is affixed with screws to base 45 in the First, Second, Fourth and Sixth Embodiments; corresponding components within the copy holder in the Third, Fifth and Seventh Embodiments are available upon removal of hood 74, FIG. 47, which is affixed with screws to base 84.

An alternate model of the copy holder in its First, Second, Fourth and Sixth Embodiments is presented in FIG. 42. "Legal sized" copy holder 220 structurally is taller than the regular model of the four back lighting embodiments, to accommodate legal sized document pages which are approximately 12 to 23 percent longer than the regular sheets customarily used. Vertical dimension of several of the structural parts in the legal sized models of the copy holder is greater than vertical dimension of corresponding parts in the regular copy holder.

In the legal sized model of the copy holder of the First Embodiment, 18 lamps 36 are used, FIG. 12, with accessory electronic components, FIG. 30, provided for them. Adjustment is made in the programming of ROMs 107 and 108 to accommodate the extra four lamps 36. In the legal sized model of the Second Embodiment, 20 LED sections 72 are used, FIG. 21, with accessory electronic components, FIG. 31, provided. Adjustment is made in the programming of ROMs 107 and 108, FIG. 29, to accommodate the extra four LED sections 72. In the legal sized model of the Fourth Embodiment, 14 liquid crystal sections LCDs 154 are used, FIG. 35, with accessory electronic components, FIG. 34, provided. Adjustment of Sectional rotary switch 152 is made to accommodate the extra two LCD sections 154. In the legal sized model of the Sixth Embodiment, 18 lamps 36, FIG. 12, are used, with accessory electronic components, FIG. 44, provided for them. Adjustment of contact disk 229, FIG. 39, and of Sectional switch 153, FIG. 44, is made to accommodate the extra four lamps 36, FIG. 12.

One other alternate model of the copy holder, in its Second and Fourth Embodiments, is presented, FIG. 43. Wide model of copy holder 221, for use by accountants and others who work with wide sheets of data, structurally is wider than the regular model of the two embodiments, to accommodate computer print-out sheets, accountancy sheets and other extra wide document pages. Lateral dimension of several structural parts in the wide models of the copy holder is greater than lateral dimension of corresponding parts in the regular copy holder.

In the wide model of the copy holder of the Second Embodiment, the same number of LED sections 72 used in the Second Embodiment itself, 16, are installed, with each section 72 comprising two rows of 23 light emitting devices each. The programming and circuitry of the Second Embodiment are kept without alteration, FIGS. 29 and 31. In the wide model of the copy holder in the Fourth Embodiment, the same number of liquid crystal devices 154, FIG. 35, used in the Fourth Embodiment itself, 12, are installed, with programming and circuitry of the Fourth Embodiment kept intact, FIG. 34. Each LCD strip is approximately 60 percent wider than the corresponding strip employed in the Fourth Embodiment copy holder.

A question may have arisen regarding the omission of fluorescent lighting in this description. A compact dinner system for fluorescent light sources has been developed by NASA with a use of high frequencies the means of reducing the bulk of fluorescent dimmer systems; the method is deemed financially infeasible. Inductive reactor systems of dimming fluorescent luminance are judged both too large and too costly for use in the present invention. Provision of several fluorescent lamps of varying power could supply a plurality of levels of luminance in the Fourth Embodiment; turning to such expedients would contravene the fine control of illumination desired for stations having wide variation in the strength and characteristics of ambient light, on behalf of operators possessing divergent degrees of visual acuity and light acceptance. The Fourth Embodiment, with the single incandescent bulb, matches the other embodiments in providing full control of light intensity in all functions.

In this disclosure of the sequentially lighting copy holder, the quantities of certain parts specified for use in said copy holder are so specified as preferred quantities, and such specification does not exclude other quantities or preclude the use of other quantities of such parts. Such specified parts include: Tilt mats 15 and 16, FIG. 4, and tilt mats 235 and 236, FIG. 47. Lamps 36, FIGS. 10 and 12. LEDs 72, FIGS. 21 and 22. Lamp assemblies 79, FIGS. 24 and 28. Bulb 151, FIG. 35. LCDs 154 . . . 156. Contacts 214, FIGS. 39 and 41. This statement of inclusion applies also to auxiliary equipment used in connection with the parts named, and the use of such parts, as presented in FIGS. 10, 12, 20, 21, 24, 30, 31, 32, 34, 35, 36, 39, 41, 44 and 46.

A rejected alternate specification should be mentioned. It is concerned with designation of the height of the field of light cast by the light emission elements of the Second and Fourth Embodiments upon the inscribed page. In the other five embodiments, which employ

14 light emission elements, the height of the field of light has been designated as a height matching that of eight standard single spaced keyboarded lines. The specification of the microprocessor First Keyboard function designates a zone of light as one accommodating approximately four standard single spaced lines. This means that all non-Sectional and non-Large Field functions are performed with fields of light approximately eight lines high, for each of said fields of light comprise two zones. The field of light of the microprocessor Descend function is cast by three zones; total luminance emitted by the dimming top zone and the brightening bottom zone light emission elements equals that emitted by a single light emission element activated at the full established intensity. The Fourth Embodiment field of light comprises a height of 1/7 more than the height of four lines; the Second Embodiment field of light comprises a height of 1/7 less than the height of four lines.

In the event that specification of the Second Embodiment should call for a zone of light to be cast by a single row of light emission devices the LEDs, FIG. 22, instead of for a zone of light cast by the two-row LED section 72, the height of the Second Embodiment field of light would be diminished by one-half. Such construction would be feasible. In the event that specification of the Fourth Embodiment should call for a zone of light to be cast by means of deactivation of liquid crystal LCDs 154 . . . 156, FIG. 35, of any height other than that actually established by the designation of a total of 16 LCDs, construction of the copy holder with any reasonable number of LCDs comprising a total height of the dimension of the inscription top to bottom would be feasible. While neither of these two specifications should be excluded, the actual specification of all details of the Second Embodiment and Fourth Embodiment is much preferred.

Finally, summary of the invention: The sequentially highlighting copy holder provides the operator with a frame of reference for keeping the place in processing a document page word by word and figure by figure, said frame of reference comprising the boundaries of fields of light cast sequentially upon succeeding portions of the inscription on said page as highlighting, said copy holder delivering, as well, illumination as such to said inscription from close up, the intensity of said illumination being infinitesimally variable.

Since some place holding functions of the copy holder performed under one control system differ in character when performed under another system, standardized terminology may be used, for reference purposes, to distinguish a function under one control from the same function under another kind of control. There follows an itemization of the identification of the light emission element used and the positioning of said element, the means of general control of said element, and the functions of the invention in each of the seven embodiments grouped by the three means of control.

First Embodiment uses back lighting incandescent lamps controlled by microprocessor. Second Embodiment uses back lighting LEDs controlled by microprocessor. Third Embodiment uses front lighting at side edges of emplaced document page, said lighting cast by pairs of incandescent lamps controlled by microprocessor. All three embodiments perform these place keeping functions: Descend, microprocessor Stride, Step, microprocessor Sectional, First Keyboard, Second Keyboard, microprocessor Advance, Large Field, Double Speed, Pause and microprocessor Rate Control functions. Light intensity, modified by operator, is controlled by use of microprocessor intensity control.

Fourth Embodiment uses incandescent bulb and deactivation of liquid crystals in back lighting controlled manually. Fifth Embodiment uses front lighting by pairs of incandescent lamps at side edges of emplaced document page, controlled manually and electronically. Both Fourth and Fifth Embodiments perform manual Step, manual Sectional and Advance place keeping functions. Light intensity is modified by manually operated control in both embodiments.

Sixth Embodiment uses back lighting incandescent lamps. Seventh Embodiment uses pairs of front lighting lamps at side edges of emplaced document page. Both Sixth and Seventh Embodiments perform electromechanical Stride, electromechanical Pause, electromechanical Sectional and electromechanical Rate Control functions. The Stride function is controlled by motor gearhead and contact assembly and by electronic circuitry. The other functions are controlled by electronic circuitry. Control of light intensity is manually operated.

It is noted that the Advance function of the three microprocessor embodiments differs from the Advance function of manual Fourth and Fifth Embodiments in that microprocessor Advance performs the added function of establishing microprocessor Sectional function fields of illumination.

I claim:

1. A copy holder for supporting and illuminating lined text for processing by an input device having a keyboard, said copy holder comprising:

a housing having a surface for supporting said lined text;

control means for selecting a portion of said lined text for illumination, said control means including, an input rate detector responsive to the rate at which input data is entered into the keyboard for producing a signal related to the input rate;

means responsive to said input rate signal for generating a signal for varying, at a rate related to the input rate, the position of the portion of said text selected for illumination in a top to bottom direction;

illumination means responsive to said variation signal for slowly decreasing the illumination intensity of a top segment of said text portion while simultaneously slowly illuminating a second portion of said text overlapping and extending below said first portion.

2. A copy holder for supporting and illuminating lined text for processing by an input device having a keyboard, said copyholder comprising:

a housing having a surface for supporting said lined text;

control means for selecting a portion of said lined text for illumination, said control means including:

means for generating a signal for varying the position of the portion of said text selected for illumination; and illumination means responsive to said variation signal for illuminating a second portion of said text on said supporting surface, said second portion overlapping a bottom segment of said first portion and further including a segment of said text below and adjacent said first portion;

wherein said illumination means is further responsive to said position varying signal for ceasing to illuminate said first portion simultaneously with the illumination of said second portion.

3. Apparatus in accordance with claim 1 or 2 wherein said control means includes manually operable means for generating a signal related to the rate at which it is desired to vary the portion of said text which is illuminated; and means responsive to said desired rate signal for activating said position varying signal.

4. Apparatus in accordance with claim 1 or 2 wherein said control means further includes manually operable means for activating a signal for causing an immediate variation of the portion of text to be illuminated; and means responsive to said immediate variation signal for activating said position varying signal.

5. Apparatus in accordance with claim 1, wherein said supporting surface is translucent and wherein said illumination means comprises:

a plurality of elongated lamps arranged within said housing in a plane approximately parallel to the plane of said supporting surface, the longitudinal axis of each said lamp being substantially parallel to the lines of said copy.

6. Apparatus in accordance with claim 1, wherein said surface is translucent and wherein said illumination means comprises:

a plurality of rows of light sources arranged within said housing in a plane substantially parallel to the plane of said supporting surface, each said row being substantially parallel to the lines of said text.

7. Apparatus in accordance with claim 19, wherein each said light source is a light emitting diode.

8. Apparatus in accordance with claim 1, wherein said supporting surface includes:

a translucent outer surface;

a translucent substrate;

a plurality of elongated liquid crystal devices horizontally positioned upon said substrate, each said liquid crystal device having an unactivated state in which it is substantially transparent and an activated state in which it is substantially opaque, and being responsive to said position varying signal for switching from its activated to its unactivated state;

and wherein said illumination source is positioned within said housing;

whereby light from said illumination source passes through said unactivated liquid crystal devices illuminating a portion of said text positioned adjacent said unactivated liquid crystal devices.

9. Apparatus in accordance with claim 1, wherein said illumination means comprises a plurality of pairs of illumination sources arranged along vertical edge portions of said surface, each said pair comprising:

a left-hand illumination source adapted to produce an elongated beam of light covering a right-hand portion of a preselected number of lines of said text; and a right-hand illumination source adapted to produce an elongated beam of light covering a left-hand portion of said preselected number of lines of said text.

10. Apparatus in accordance with claim 1, wherein said detector is a sensor operatively connected to a moving part of said keyboard device and adapted to produce a signal related to the movement of said part.

11. Apparatus in accordance with claim 1, wherein said detector is a sensor operatively connected to an end-of-line return key of said keyboard device and adapted to produce a signal related to depressions of said end-of-line return key.

12. Apparatus in accordance with claim 1, wherein said illumination means is responsive to said position varying signal to decrease the illumination of said top segment from fully illuminated to non-illuminated in approximately three seconds and to increase the illumination of said second portion from non-illuminated to fully illuminated in approximately three seconds.

13. Apparatus in accordance with claim 1, wherein said housing comprises:

a rigid hood;

a rigid base fixedly connected to said hood and having a mass substantially greater than said hood for insuring that said apparatus has a low center of gravity.

14. Apparatus in accordance with claim 1, wherein said housing further includes a mask for preventing margins of said text from being illuminated.

* * * * *

UNITED STATES PATENT AND TRADEMARK OFFICE

CERTIFICATE OF CORRECTION

PATENT NO. : 4,385,461

DATED : May 31, 1983

INVENTOR(S) : Hale Wingfield

It is certified that error appears in the above-identified patent and that said Letters Patent are hereby corrected as shown below:

In claim 5, column 41, line 58, change "1" to --1 or 2--.

In claim 6, column 42, line 1, change "1" to --1 or 2--.

In claim 7, column 42, line 8, change "19" to --6--.

In claim 8, column 42, line 10, change "1" to --2--.

In claim 9, column 42, line 27, change "1" to --1 or 2--.

In claim 12, column 42, line 48, change "1" to --2--.

In claim 13, column 42, line 55, change "1" to --1 or 2--.

In claim 14, column 42, line 62, change "1" to --1 or 2--.

Signed and Sealed this

*Twenty-seventh* Day of *September 1983*

[SEAL]

*Attest:*

*Attesting Officer*

GERALD J. MOSSINGHOFF

*Commissioner of Patents and Trademarks*